US007475621B2

(12) United States Patent
Wang

(10) Patent No.: US 7,475,621 B2
(45) Date of Patent: Jan. 13, 2009

(54) KERF CONTROL APPARATUS FOR A TABLE SAW

(76) Inventor: Henry Wang, 660 Sumter Ct., Winter Springs, FL (US) 32708

( * ) Notice: Subject to any disclaimer, the term of this patent is extended or adjusted under 35 U.S.C. 154(b) by 0 days.

(21) Appl. No.: 11/426,604

(22) Filed: Jun. 27, 2006

(65) Prior Publication Data

US 2006/0230895 A1 Oct. 19, 2006

Related U.S. Application Data

(63) Continuation-in-part of application No. 10/979,939, filed on Nov. 2, 2004, now Pat. No. 7,293,488.

(60) Provisional application No. 60/700,436, filed on Jul. 19, 2005.

(51) Int. Cl.
*B27B 5/06* (2006.01)

(52) U.S. Cl. ..... 83/102.1; 83/477.2; 30/371

(58) Field of Classification Search ..... 83/102.1, 83/440.2, 477.2, 478, 544; 30/371, 373; 144/253.1

See application file for complete search history.

(56) References Cited

U.S. PATENT DOCUMENTS

| | | | | |
|---|---|---|---|---|
| 421,861 | A | 2/1890 | French | |
| 482,507 | A | 9/1892 | Foster | |
| 565,940 | A | 9/1896 | Stevens | |
| 816,326 | A * | 3/1906 | Hill | 83/478 |
| 2,593,596 | A * | 4/1952 | Olson | 83/102.1 |
| 3,566,934 | A | 3/1971 | Thrasher | |
| 3,583,450 | A * | 6/1971 | Gunnerman | 83/701 |
| 4,516,612 | A * | 5/1985 | Wiley | 83/102.1 |
| 4,534,112 | A | 8/1985 | Bass | |
| 4,625,604 | A | 12/1986 | Handler et al. | |
| 4,896,708 | A | 1/1990 | Dietz | |
| 5,146,964 | A | 9/1992 | Dietz | |
| 5,253,686 | A | 10/1993 | Dietz | |
| 5,287,779 | A | 2/1994 | Metzger, Jr. | |
| 5,447,085 | A | 9/1995 | Gochnauer | |
| 6,170,370 | B1 | 1/2001 | Sommerville | |

(Continued)

OTHER PUBLICATIONS

Tools Plus Internet web page Illustrating Merlin splitter.

(Continued)

*Primary Examiner*—Stephen Choi
(74) *Attorney, Agent, or Firm*—David G. Maire; Beusse Wolter Sanks Mora & Maire, PA

(57) ABSTRACT

An apparatus (148) for controlling a kerf formed in a work piece by a table saw blade. The apparatus may include a splitter (114) securely positioned to the saw table behind the saw blade, and a kerf keeper (118) that is positioned behind the splitter while the kerf remains open. The kerf keeper may be easily displaced and will automatically move with the work piece when pinched by a closing kerf, thereby keeping the kerf opened and limiting the amount of force exerted by the closing kerf on the saw blade and the splitter. A drill guide base (110) and optionally an adjustable rear drill guide (112) provide for precisely locating the mounting holes for the splitter and kerf keeper relative to the sides of an actual kerf formed by the saw blade. The splitter and/or kerf keeper may be formed by injection molding of a plastic coating (176) over a stamped or die cut metal core (174).

3 Claims, 19 Drawing Sheets

U.S. PATENT DOCUMENTS

| | | | |
|---|---|---|---|
| 6,405,624 | B2 | 6/2002 | Sutton |
| 6,463,922 | B2 | 10/2002 | Petitjean |
| 6,578,460 | B2 | 6/2003 | Sartori |
| 6,715,388 | B1 | 4/2004 | Jaksha |
| 6,736,042 | B2 | 5/2004 | Behne et al. |
| 7,234,380 | B2 * | 6/2007 | Garcia ..... 83/102.1 |

OTHER PUBLICATIONS

SawStop. 10" Cabinet Saw. http://www.sawstop.com/products-cabinet-saw.htm.

* cited by examiner

KERF CONTROL APPARATUS FOR A TABLE SAW

RELATED APPLICATIONS

This application is a continuation-in-part of U.S. application Ser. No. 10/979,939 filed 2 Nov. 2004 now U.S. Pat. No. 7,293,488. This application also claims benefit of the 19 Jul. 2005 filing date of U.S. provisional application 60/700,436.

FIELD OF THE INVENTION

This invention relates generally to the field of woodworking, and more specifically to an apparatus for controlling a kerf formed in a work piece behind a table saw blade.

BACKGROUND OF THE INVENTION

It is known to position a splitter device behind the circular saw blade of a table saw to maintain separation of the cut material by virtue of its location in the kerf. The term behind is used herein to mean downstream of the saw blade in the direction of movement of a work piece past the blade. Splitters generally consist of a thin piece of metal supported in the plane of the saw blade. A splitter functions to prevent the cut portion of the material from rubbing against the upwardly moving rear portion of the saw blade, which could result in dangerous kickback of the work piece and/or charring of the work piece surface. Various types and arrangements of splitters are well known in the art. See for example, U.S. Pat. No. 482,507 which issued on Sep. 13, 1892 and describes a kerf spreader that is affixed to a saw table. It is also known to utilize a European-style riving knife, which is a splitter that moves with the saw blade rather than being affixed to the saw table.

Modern table saws are often provided with a combination splitter, anti-kickback pawl and guard. Certain table saw operations require the removal of such combination devices due to physical interferences, such as the guard interfering with narrow ripping, the guard and the anti-kickback pawls obstructing tenon cutting when the board is vertically oriented, and the anti-kickback pawls causing binding on certain type of cross cutting. The removal and reinstallation of such devices is often troublesome and time consuming, such as with combination devices shown in U.S. Pat. Nos. 4,625,604 and 6,405,624. Many table saw owners permanently remove their splitter combination devices to avoid such inconvenience.

FIG. 1 is a top view illustration of a prior art splitter being used on a table saw. A saw blade 10 extends through a saw slot in a work surface 12 upon which a work piece 14 is supported. As the work piece 14 is urged past the saw blade 10, a saw cut or kerf 16 is created that separates the off-cut piece 18 from the keeper piece 20. Straight line movement of the work piece 14 past the saw blade 10 is ensured by keeping an alignment edge 22 of the work piece 14 against a rip fence 24, which is, in turn, securely supported to extend above the work surface 12 in a plane parallel to the saw blade 10. Splitter 26 is supported in a position behind the saw blade 10 and extends above the work surface 12 within the kerf 16.

Proper alignment of the splitter 26 relative to the saw blade 10 is known to be important for proper functioning of the splitter 26. A splitter on a circular table saw is generally thinner than the saw blade and the kerf it creates. If the splitter 26 is directly centered behind the saw blade 10, a small gap will exist between the splitter 26 and the off-cut piece 18 as well as between the splitter 26 and the keeper piece 20. Such gaps reduce the effectiveness of the splitter by allowing the respective portions of the work piece to move toward the saw blade 10. Often, such a splitter 26 is aligned and installed to be flush with the side of the saw blade 10 facing the rip fence 24 to deny the keeper piece 20 from contacting the saw blade 10. However, precise alignment of a splitter relative to a saw blade is known to be a difficult task. One known method of alignment is to place a straight edge against the side of the saw blade, then to affix the splitter into position against the straight edge. This method achieves alignment of one side of the splitter with one side of the saw blade; however, it augments the gap remaining between the other side of the splitter and the other side of the saw blade.

Splitters that maintain contact with both the off-cut piece 18 and the keeper piece 20 are also known. U.S. Pat. No. 6,715,388 issued on Apr. 6, 2004, describes a rotatable splitter holder mounted behind a saw blade. The position of a splitter pin extending into the kerf above the holder is controlled by the rotation of the holder. Two pins may be positioned on the holder, one on each opposed side of the axis of rotation, to make contact with both the off-cut piece and the keeper piece. The rotation of such a two-pin holder will change the width between the pins within the kerf, thereby accommodating various widths of saw blades. U.S. Pat. No. 3,566,934 issued on Mar. 2, 1971, describes a splitter that includes a plurality of resilient contacts that project toward the opposed sides of the kerf to make contact with both the off-cut piece and the keeper piece. If such dual-contact splitters are not precisely centered behind the saw blade, excessive contact pressure may be exerted against one side of the kerf, while inadequate or no pressure may be exerted against the opposed side.

BRIEF DESCRIPTION OF THE DRAWINGS

The invention is explained in following description in view of the drawings that show.

DETAILED DESCRIPTION OF THE INVENTION

The present inventor has recognized that prior art splitter designs fail to provide the precision that is desired by highly skilled wood workers. Prior art splitter designs and installation techniques focus on the saw blade in its stationary, non-rotating condition. In reality, every saw blade will create a kerf that is somewhat wider than the width of the stationary blade due to vibration induced in the blade as it rotates, unevenly installed saw teeth, and/or the rip fence not being parallel to the saw blade. Furthermore, this variation in kerf width may vary from blade to blade of the same type. The present invention overcomes this problem with an innovative splitter design and installation technique, as described more fully below.

Figure 1:
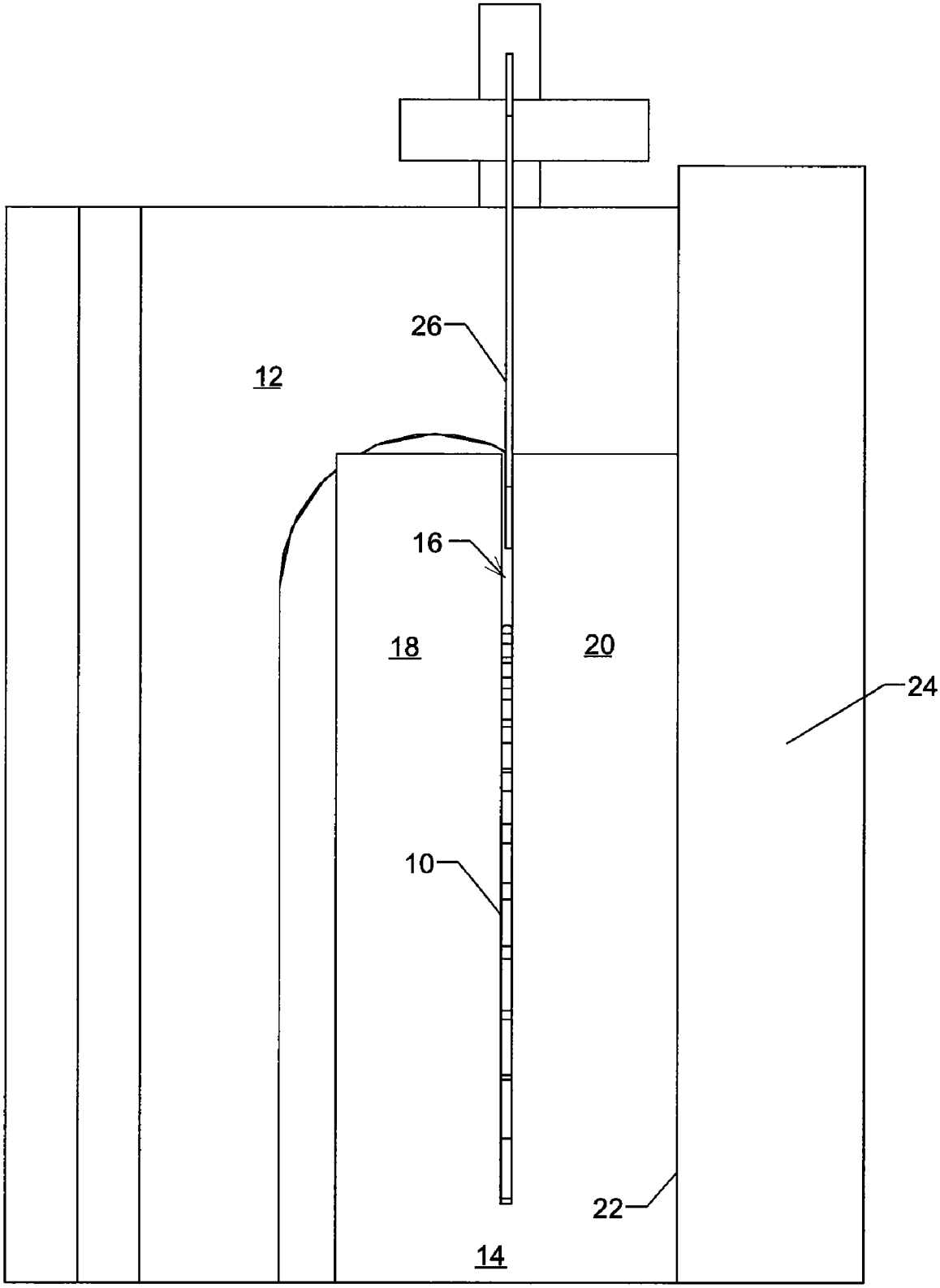
FIG 1 PRIOR ART
FIG. 1 is a top view of a saw table with a prior art splitter being used to cut a work piece.
Figure 2:
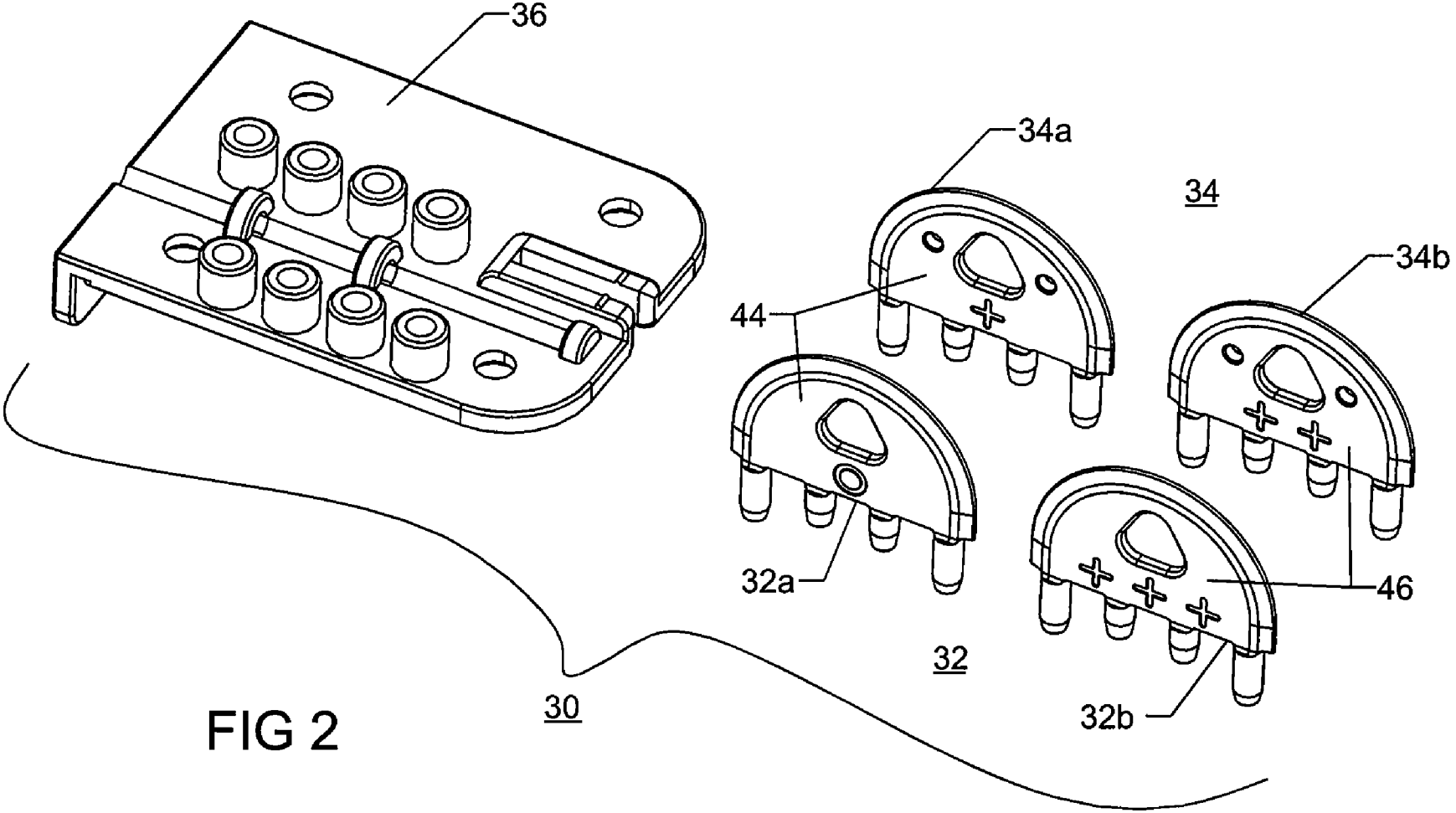
FIG. 2 illustrates a kit containing splitters and a drill guide.
Figure 3:
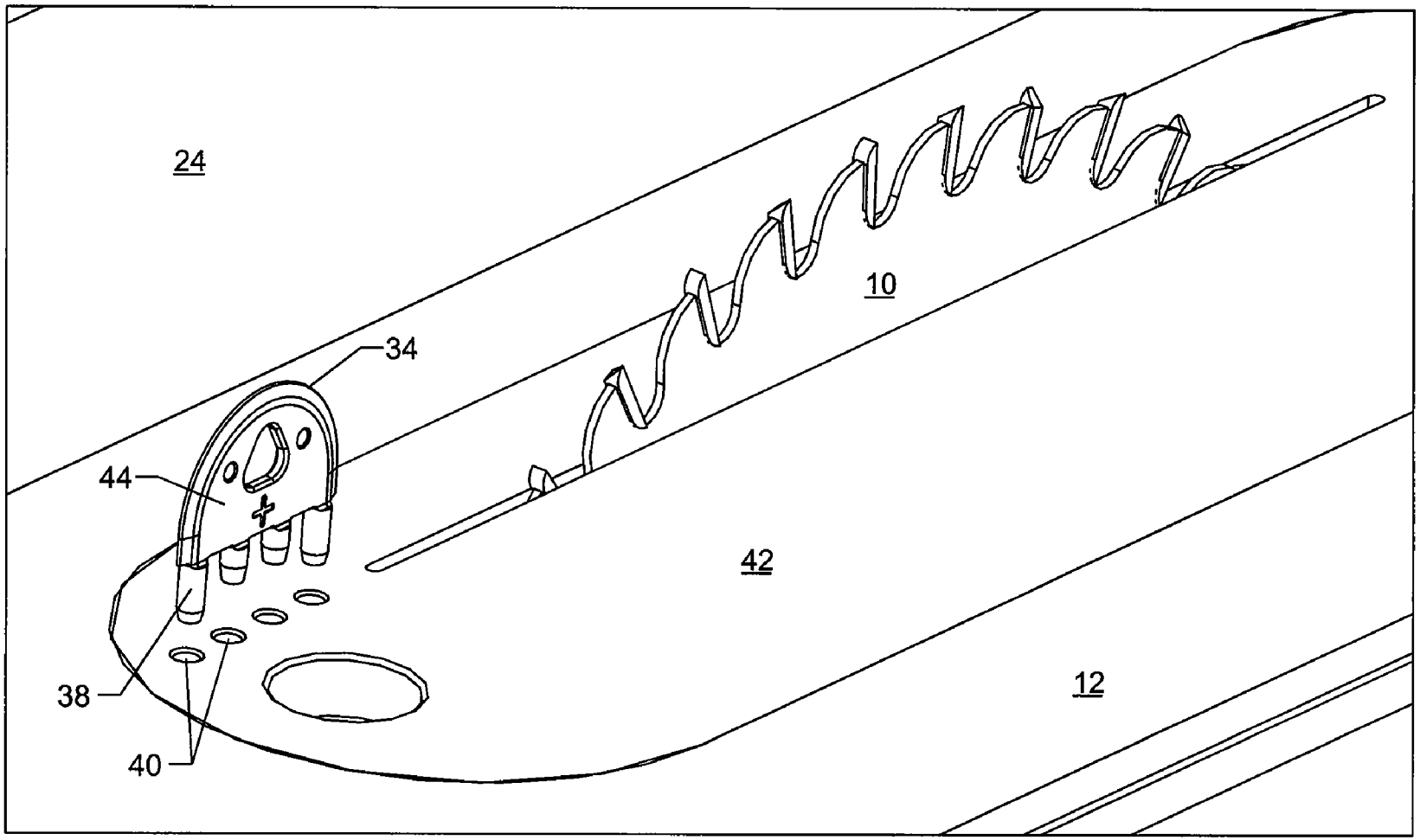
FIG. 3 is a perspective view of a splitter being installed into splitter location holes in a zero clearance insert of a table saw.

FIG. 2 illustrates a kit 30 containing a plurality of splitters 32*a*, 32*b*, 34*a*, 34*b* (sometimes referred to collectively with only numeral 32 or 34) and an installation drill guide 36 that is used to locate holes for mounting the splitters during use. As illustrated in FIG. 3, each splitter 32 contains a plurality of pegs 38 that are removeably inserted into a respective plurality of holes 40 drilled into the work piece support surface directly behind the saw blade 10. For most common table saw designs where a zero clearance insert (ZCI) 42 is installed, the holes 40 are drilled into the ZCI 42 that forms part of the work piece support surface. In an aspect of the present invention, the drill guide 36 is used to index the holes 40 relative to one side of an actual kerf created by the saw blade 10 rather than relative to the saw blade 10 itself. A generally planar work piece contacting portion 44 of the splitters 32 extends vertically from the pegs 38, with the planar portion 44 being parallel to and offset at a known location relative to a centerline of the pegs 38. In this manner, when the splitter 32 is installed into holes 40, the planar portion 44 of the splitter is precisely and repeatedly located relative to the side of the kerf with a known amount of offset, regardless of the actual width of the saw blade or the actual amount of vibration generated during use of the blade. The embodiments illustrated herein all include a plurality of pegs 38 and a respective plurality of holes 40 having a generally circular cross-section.

In one embodiment of the present invention, splitters 32*a*, 32*b*, 34*a*, 34*b* having differing offset distances between the planar portion 44 and the centerline of the pegs 38 are provided, as indicated by the designations "0", "+", "++" and "+++" marked on the splitters 32*a*, 34*a*, 34*b*, 32*b* respectively. In this manner, a desired degree of interference may be created between the planar portion 44 and the side of the actual kerf. When the splitter 32 is formed of an impact resistant material such as an injection molded polycarbonate material (a plastic material with inherent material characteristics that create a rigid springy effect when desired), the selected degree of interference between the splitter 32 and the work piece provides a desired amount of force urging the work piece away from the saw blade 10.

In a further embodiment, a single splitter 32 may be formed to have a first planar work piece contacting surface 44 that is a first distance from the centerline of the pegs 38, and to have a second planar work piece contacting surface 46 opposed the first planar surface 44 that is a second distance from the centerline of the pegs 38 and different than the first distance. When the number and orientation of the pegs 38 is symmetrical to the axis of the kerf, a single splitter 32 may be installed reversibly into the holes 40 to provide two different degrees of interference. Thus, splitters 32*a* and 32*b* may be identical but are viewed in FIG. 2 from opposed sides. Similarly, splitters 34*a* and 34*b* may be identical to each other but with offsets that are different than splitters 32*a* and 32*b*. Kit 30 may be provided with any number of splitters, for example two different reversible splitters providing four options for the offset distance. The splitters illustrated in the drawings include four pegs 38, however, other embodiments having any different number of pegs may be used as appropriate for a particular design. The inventor has used a four-peg embodiment for a relatively thin splitter and a three-peg embodiment for a thicker splitter where somewhat less mechanical support is needed for the planar portion of the splitter. One skilled in the art will also appreciate that other embodiments are possible wherein the cross-section of such parts is not circular, wherein the number of holes and the number of pegs is not equal such as to provide in-line position flexibility, where only one peg of any cross-sectional shape is used such square, triangular or key shaped, wherein the position of the male and female components are reversed or are alternated, etc., provided that the planar portion of the splitter is positioned at a known location relative to the hole(s).

Figure 4:
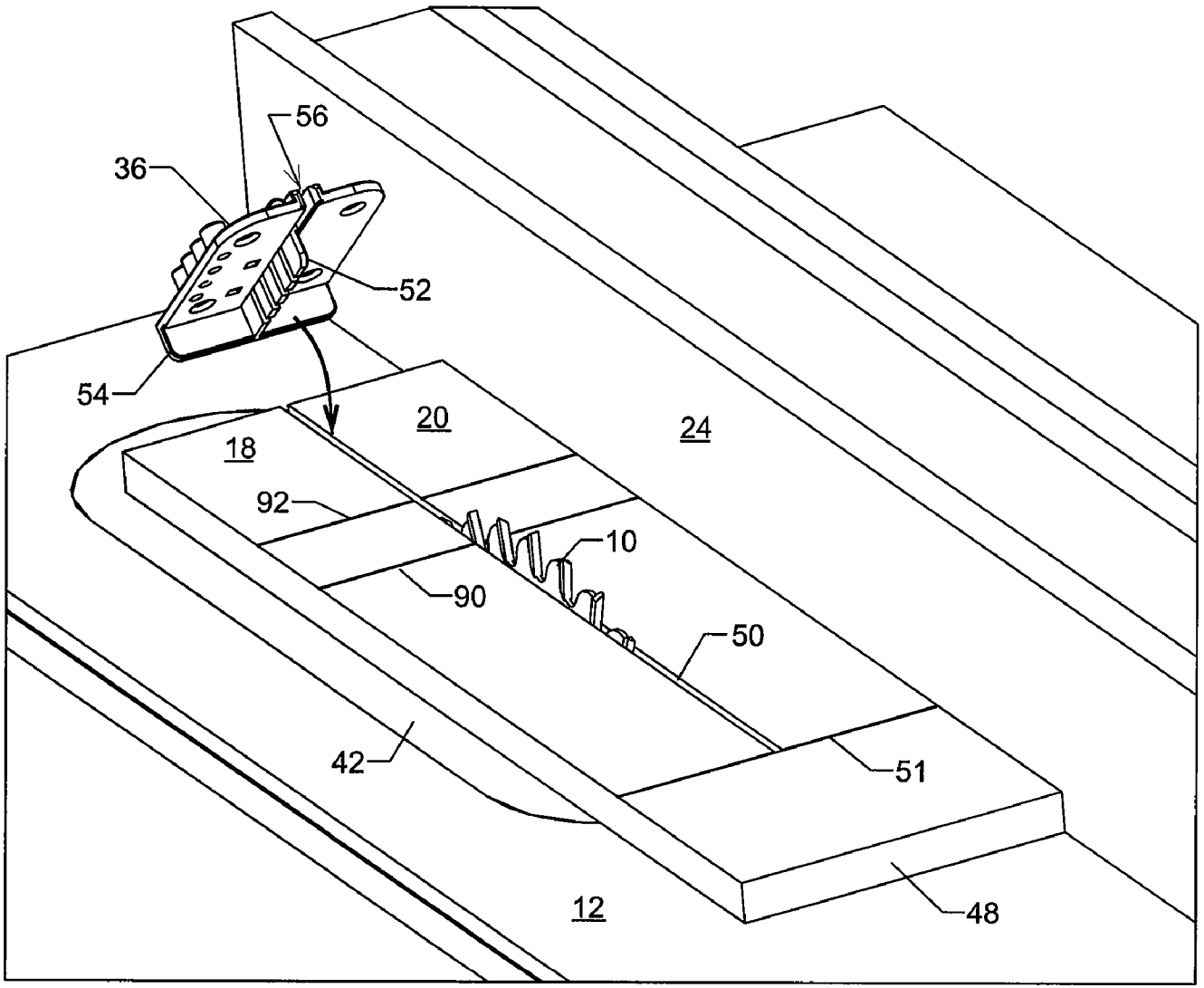
FIG. 4 is a perspective view of a drill guide being installed onto a setup board.
Figure 5:
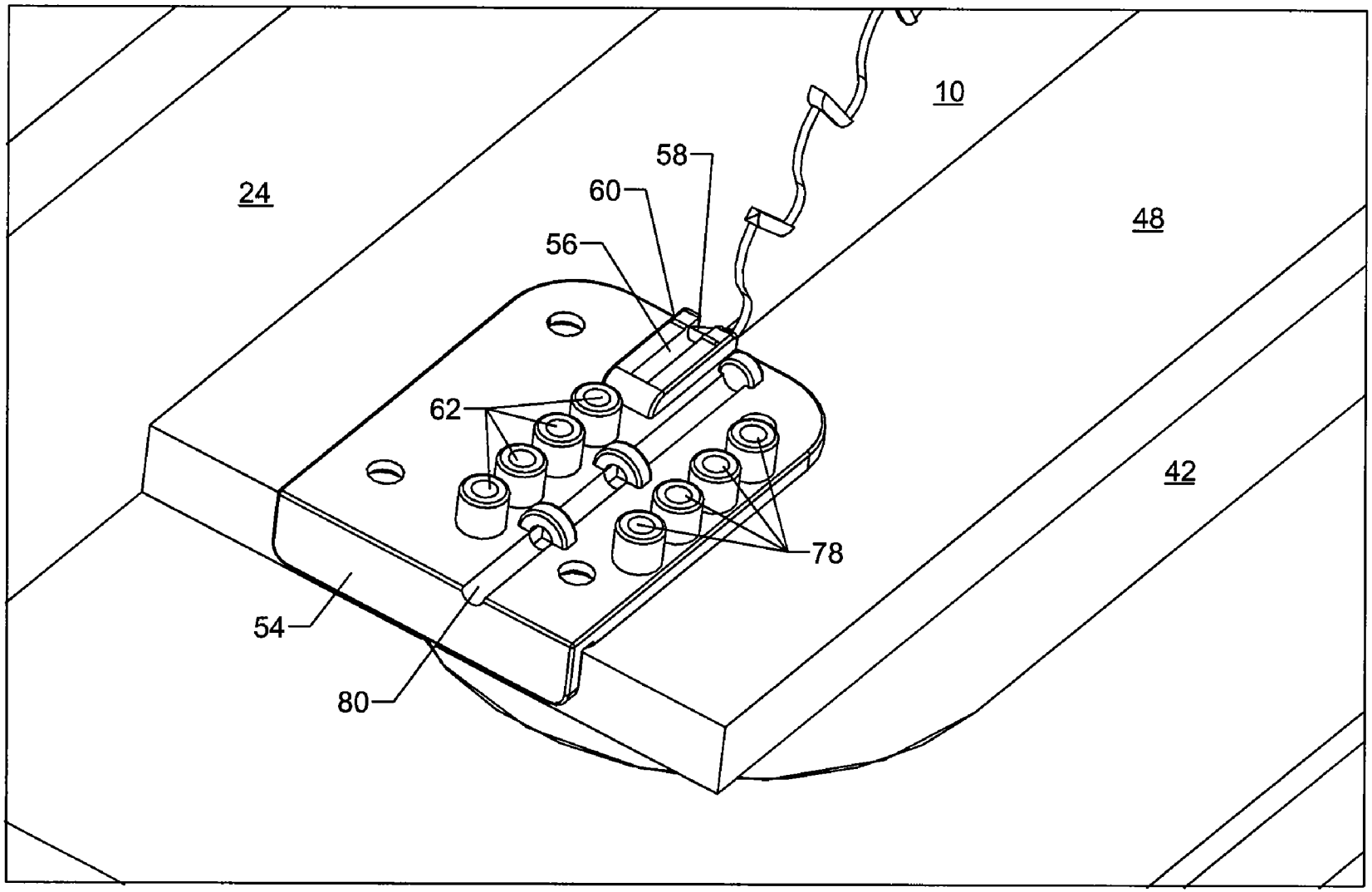
FIG. 5 is a perspective view of the drill guide positioned on the setup board.

A method of installing splitter 32 is now described, beginning with steps illustrated in FIG. 4. A setup board 48 is provided having known dimensions. The board may be a flat piece of dimensionally stable plywood or a medium density fiberboard or other flat material suitable for the steps described below. A saw kerf 50 is cut into the setup board 48 but only to a limited distance, such as to a line 51 drawn on the board 48 approximately three inches from the uncut end of the board. The length of uncut board should be sufficient to provide support for the off-cut piece 18 and keeper piece 20 to maintain the kerf 50 in position. Because the actual kerf 50 that is made by the saw blade 10 is used in later steps to position the drill guide 36, it is important that the setup board 48 be kept in contact with the fence 24 while the cut is being made and that the fence 24 is parallel to the saw blade 10. The power to the saw may be disconnected for safety during the following steps. The saw blade 10 is raised to its highest position and the drill guide 36 is positioned on the end of the board 48 with its downwardly extending center rib member 52 positioned into the kerf 50, as shown in FIG. 4, and with its rear wall 54 abutting the cut end of the board 48, as shown in FIG. 5. The board 48/guide 36 are then moved toward the saw blade 10 so that one of the teeth of the blade 10 enters the front opening slot 56 of the guide 36. Positioning of the guide 36 may be achieved when the tip of a first exposed one of the saw blade teeth 58 is aligned with an alignment mark 60 on the top of the guide 36. With the setup board 48 having a predetermined thickness and the drill guide 36 having known dimensions, this process will establish the distance of the guide holes 62 behind the saw blade 10 when the blade is fully raised. As will be described more fully below, the position of the guide holes 62 determines the later location of an installed splitter. It is know to position a splitter as close to the saw blade as practical. The location of the alignment mark 60 is selected to ensure that the saw blade 10 will not come into contact with an installed splitter during use. Methods other than the use of an alignment mark 60 may be used to establish a desired position of the guide 36/guide holes 62/splitter.

Figure 6:
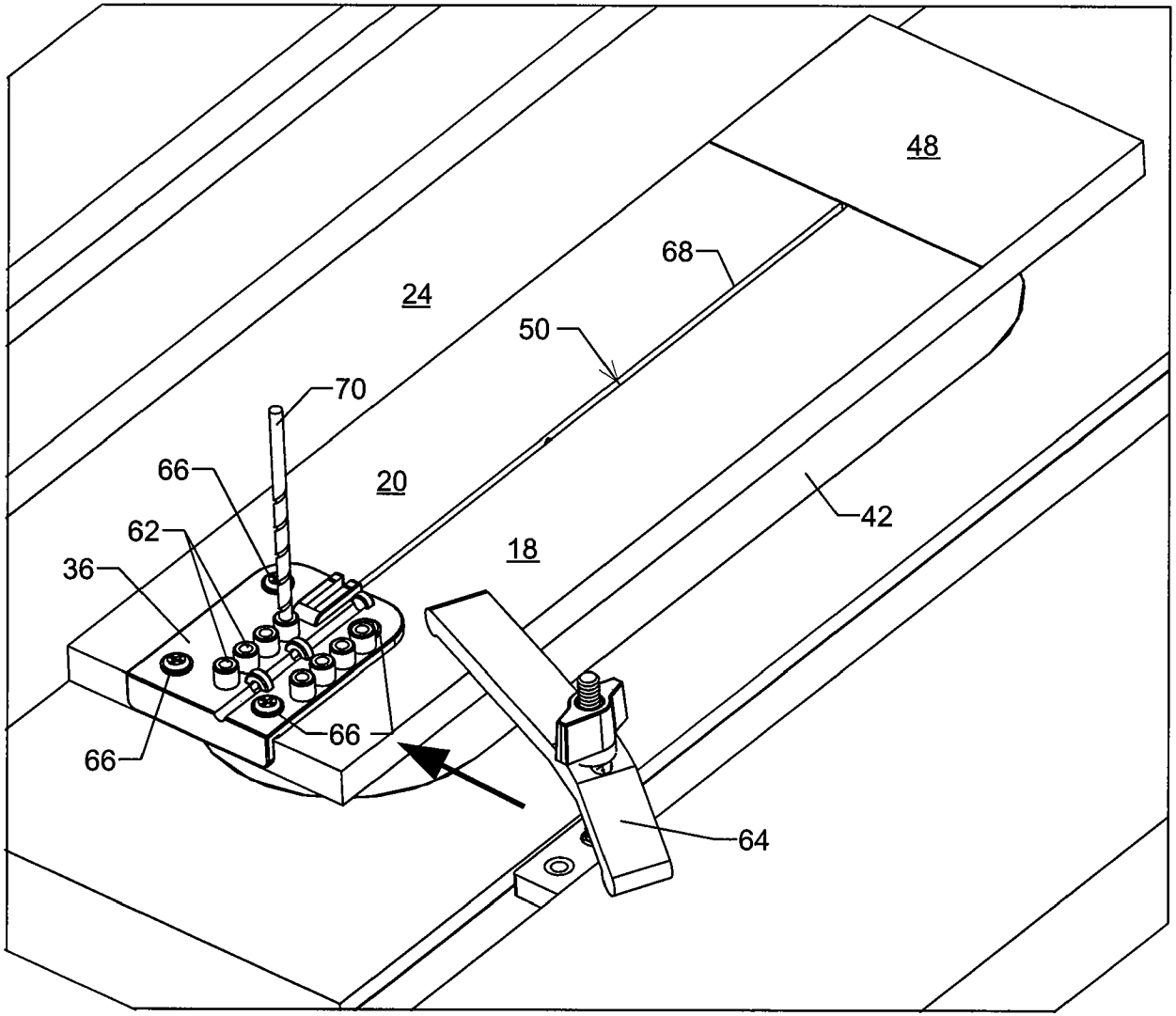
FIG. 6 is a perspective view of the drill guide in position for drilling of the splitter location holes.

The saw blade 10 is then lowered without altering the position of the setup board 48, and the setup board 48 is secured into position, such as with clamp 64 shown in FIG. 6. The clamp 64 should be fastened against the setup board 48 while applying firm finger pressure or feather board pressure from the side of the board 48 away from the fence 24 in a direction toward the fence 24, as indicated by the arrow in FIG. 6. This will ensure that the right edge (as viewed from the perspective of a person operating the saw) of the center rib 52 of the drill guide 36 is a contacting surface in full contact with the right side of the kerf 50. Due to the construction of the guide 36, this will also align the centers of the guide holes 62 at a predetermined fixed distance from, and in a line parallel to, the right edge 68 of the kerf (the actual cut edge 68 of the keeper piece 20) regardless of any variation in the saw blade thickness or any vibration-induced widening of the kerf 50.

The drill guide 36 is then secured to the setup board 48 using mounting screws 66, and then splitter location holes 40 are drilled into the ZCI 42 by inserting a drill bit 70 through each of the guide holes 62. Care should be taken to keep the drill bit 70 perpendicular to the top surface of the work piece during the drilling process to ensure precise positioning of the splitter location holes 40. The guide holes 62, drill bit 70 and the pegs 38 preferably have the same diameter for an accurate installation and precision in the use of the device. The thickness of the material of the guide 36 and the board 48 help to maintain the stability and verticality of the drill bit 70, since the material that surrounds and defines the elongated guide holes 62 will tend to support the drill bit 70 in a vertical orientation. In the illustrated embodiment of drill guide 36, the guide holes 62 have a diameter that is larger than the width of center rib 52, thereby allowing the guide four holes 62 to segment the center rib 52 into five sections. This exposes the board 48 to the drill bit 70 and allows the right and left kerf edges of the set-up board 48 which are now in direct firm contact with the opposing segmented surfaces of the center rib 52 to function as part of the support for the drill bit 70 during the drilling operation. In other embodiments the diameter of the guide holes may be smaller than the width of the center rib, thereby allowing the drill bit to pass entirely through the kerf of the board within the confines of the center rib. The result of the above steps is that the splitter location holes 40 are referenced from the actual cut edge 68 of the keeper piece 20 rather than from a side or center of the saw blade 10, thereby eliminating inaccuracies in splitter location related to variations in saw thickness and saw blade vibration. The clamp 64 is then released and the entire setup is removed, and the ZCI 42 is ready to receive a splitter.

Figure 7:
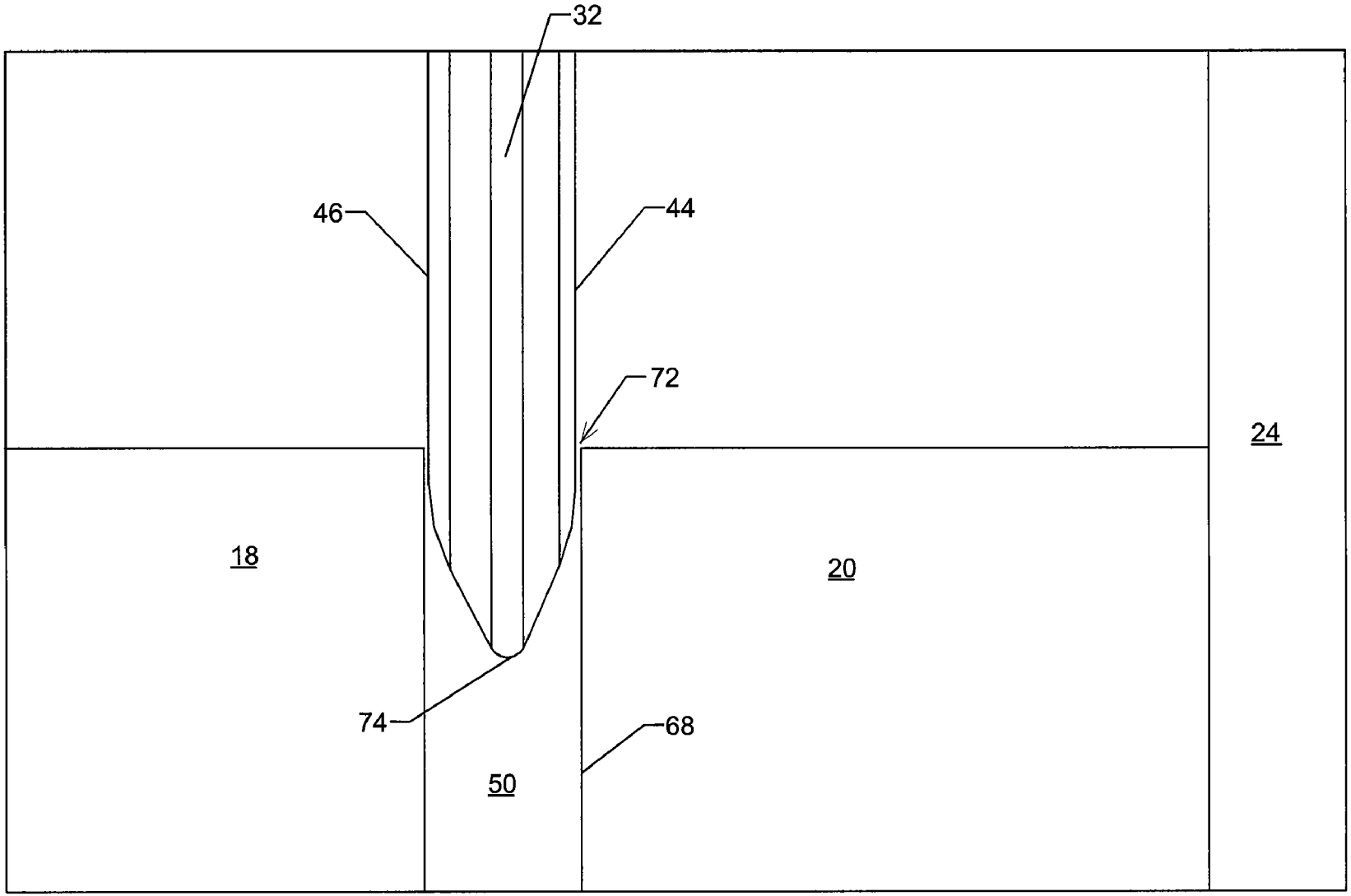
FIG. 7 is a top view of a first configuration of a splitter illustrating the relative locations of the splitter planar surface and the cut edge of the kerf.
Figure 8:
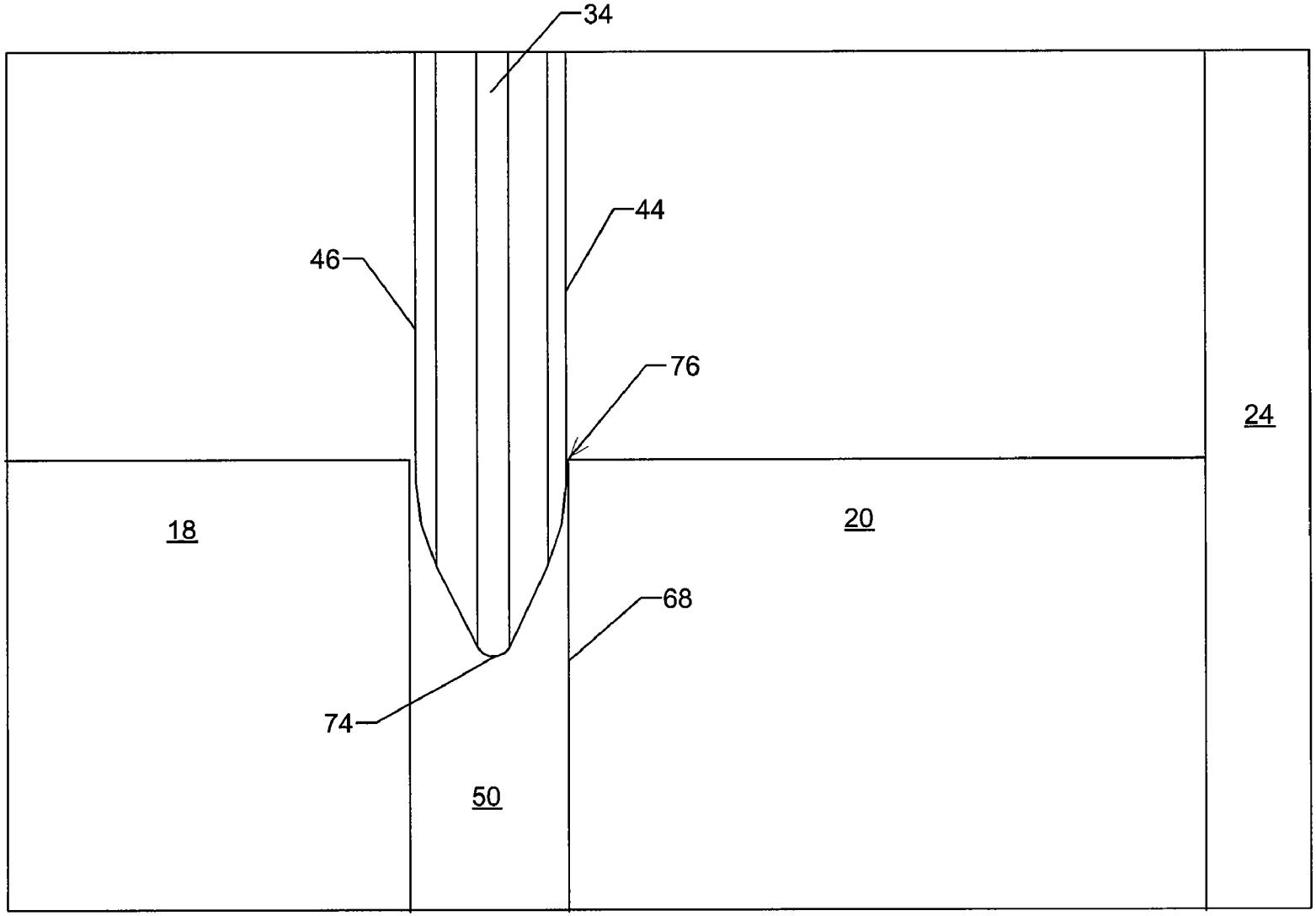
FIG. 8 is a top view of a second configuration of a splitter illustrating the relative locations of the splitter planar surface and the cut edge of the kerf.
Figure 9:
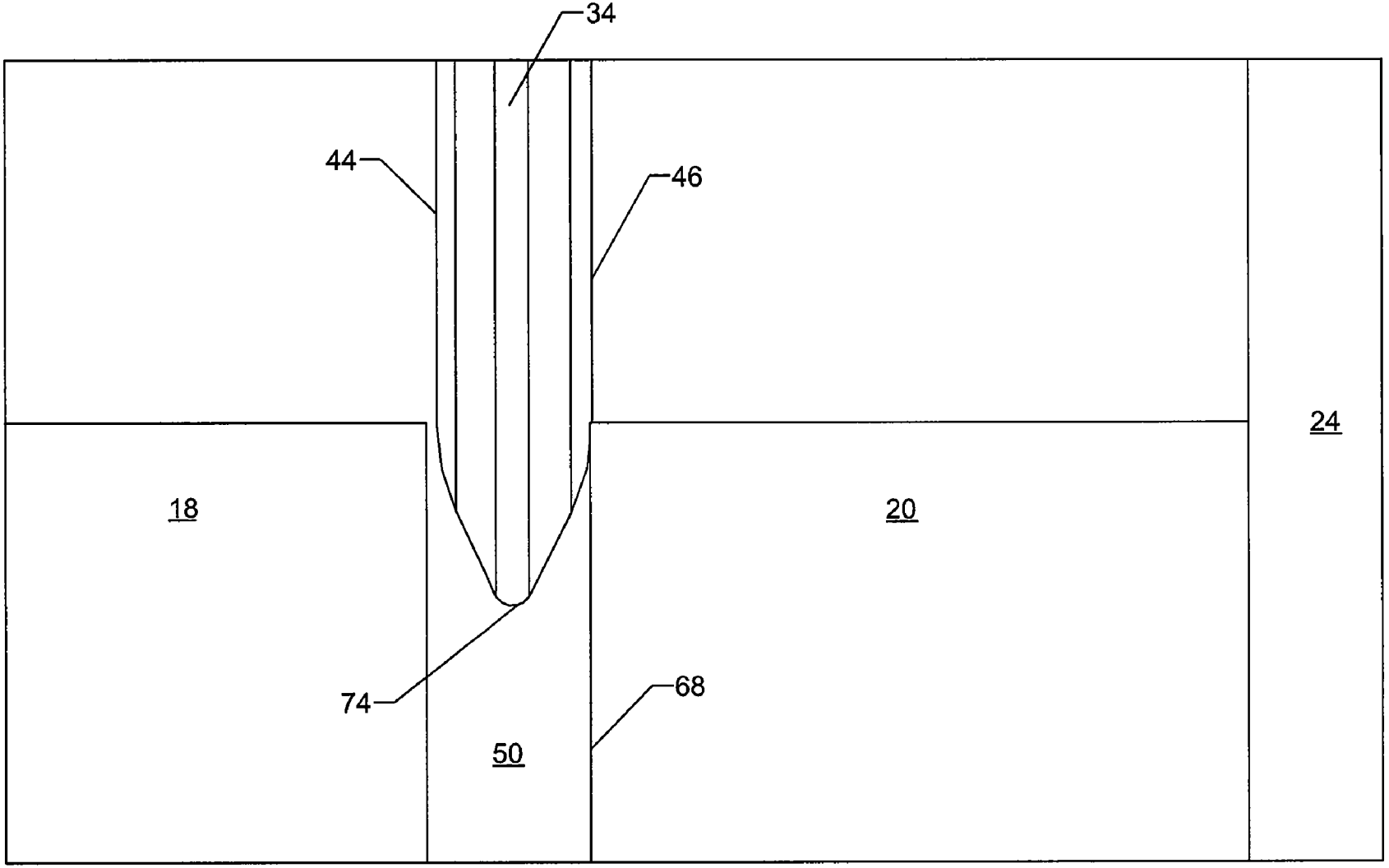
FIG. 9 is a top view of a third configuration of a splitter illustrating the relative locations of the splitter planar surface and the cut edge of the kerf.

The pegs 38 of a splitter 32 are inserted into splitter location holes 40 in preparation for using the splitter 32 during a cutting operation. As discussed above with respect to splitters 32*a*, 32*b*, 34*a* and 34*b*, a plurality of different splitters may be provided to fine tune the precise location of the planar surface 44 with respect to the actual edge 68 of the kerf 50. FIGS. 7, 8 and 9 illustrate splitters with different offset distances being installed with respect to the same kerf 50, off-cut piece 18 and keeper piece 20. FIG. 7 illustrates one embodiment wherein the first planar surface 44 of the splitter is positioned the closest to the centerline of the pegs 38, such as may be embodied in a splitter 32 with its side marked as "0" positioned on the right side. In this embodiment there may exist a small gap between first planar side 44 and the cut edge 68 of keeper piece 20. Note that the leading edge 74 of the splitter may be tapered to facilitate movement of work pieces past the splitter. FIG. 8 illustrates an embodiment wherein the first planar surface 44 is positioned somewhat farther from the centerline of the pegs 38 than in FIG. 7, such as may be embodied in splitter 34 with its side marked as "+" being positioned on the right side. In this embodiment there may exist a very small gap 76 or no gap at all may exist between first planar side 44 and the cut edge 68 of keeper piece 20. In one embodiment there is a 0.003" difference in size between gap 72 and gap 76; i.e. between the location of the "+" side of splitter 34 verses that of the "0" side of splitter 32 relative to the centerline of the pegs 38. FIG. 9 illustrates an embodiment wherein the splitter 34 is rotated 180° compared to its position in FIG. 8. The second planar surface 46 marked as "++" is positioned even farther from the centerline of the pegs 38 than the first planar surface 44. In this embodiment the edge 68 of the kerf 50 interferes slightly into the planar surface 46, thereby slightly bending the planar surface 46 and creating a slight force pressing against the edge 68, like a mini feather board. This force tends to keep the keeper piece 20 against the rip fence 24, resulting in a safer cut. In one embodiment there is a 0.003" difference between the location of the "++" side of splitter 34 verses that of the "+" side of splitter 34 relative to the centerline of the pegs 38. One may envision that any desired amount of interference may be achieved between the splitter and the cut edge of the work piece by providing an appropriately configured splitter having a desired amount of offset between its planar surface and the centerline of its installation pegs. The difference in offset between different splitters may be any particular distance; for example, another embodiment may have a 0.002" difference between two different splitters. The amount of force exerted on the work piece as a result of the interference can also be affected by the material of construction and the mechanical design of the splitter, thus providing additional flexibility in the splitter design and selection process. This invention facilitates the easy installation and removal of a splitter so that the operator can make micro incremental offset adjustments to provide the particular amount of force desired for a particular cut. As the cut edge of a board moves past the splitter, the operator will be able to feel the work piece make contact with the splitter, thereby providing feedback that the splitter offset is correct and that a desired amount of force is being applied to the side of the kerf. Too little or too much interference may be detectable by the operator once he/she gets the "feel" of the device, thereby providing a reassuring feedback signal to the operator when the setup is correct.

Kit 30 of FIG. 2 may be provided with any variety of such differently configured splitters. Kit 30 may also include appropriate hardware such as drill bit 70 and mounting screws 66. For splitters having a symmetric peg arrangement, reversible splitters may be provided having two opposed planar surfaces 44, 46, such as a "+" on one side and a "++" on the opposed side, or a "0" on one side and a "+++" on the opposed side. The thickness of the generally planar portion of the splitter that defines these opposed work-piece contacting surfaces may be the same for splitters having different combinations of offset distances, with the difference between splitters being accomplished by differing the location of the planar portion relative to the centerline of the pegs. Alternatively, the difference in the offset between two splitters may be accomplished by providing generally planar portions having different thicknesses. Once the ZCI 42 is drilled, a variety of applications may be accommodated by simply removing one splitter from the splitter location holes 40 and installing a preferred splitter configuration. When not in use, the splitter 32 may be stored with the drill guide 36 by inserting the splitter pegs 38 into the guide holes 62. Storage for a second splitter may be provided via storage holes 78, and storage for the drill bit 70 may be provided via storage slot 80, as most clearly seen in FIG. 5.

Figure 10:
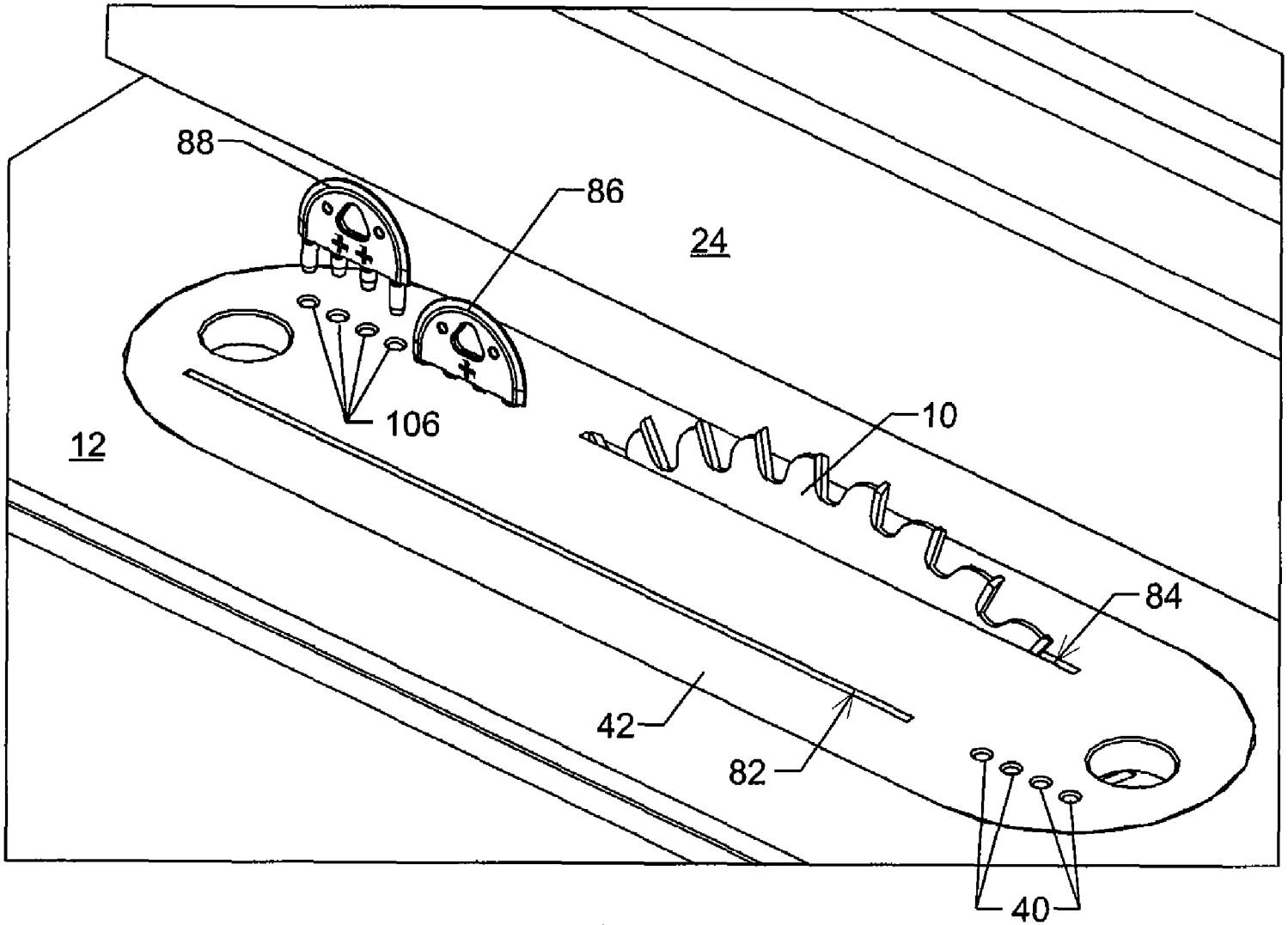
FIG. 10 is a perspective view of a zero clearance insert configured for two heights of saw blades; one configuration utilizing a single splitter and the other configuration using dual splitters.

FIG. 10 illustrates another embodiment of the present invention. The zero clearance insert 42 in this embodiment can be installed in either of two directions rotated 180° from each other so that the saw blade 10 can be made to protrude between either of two saw slots 82, 84. A plurality of splitter location holes 40 have been drilled into the ZCI 42 in association with the first saw slot 82 that extends a sufficient distance to accommodate the saw blade 10 in its highest position for cutting the thickest stock material. A second saw slot 84 is made in the reversible ZCI 42 to receive the saw blade 10 in only a partially raised position for cutting thinner stock material. A first splitter 86 is installed downstream of the saw slot 84 for making contact with the right side (keeper piece side) of the kerf to urge the keeper piece toward the rip fence 24. A second splitter 88 is installed downstream of the first splitter 86 for making contact with the left side (off-cut piece side) of the kerf. Alternatively, the first splitter 86 could be installed to make contact with the left side of the kerf and the second splitter 88 could be installed to make contact with the right side of the kerf, which may be preferred if the rip fence is located on the left side of the blade 10. In the embodiment of FIG. 10 both splitters 86, 88 are installed on the ZCI 42, although other embodiments may utilize one or two splitters installed on any appropriate region of a work piece support surface, whether or not the surface includes a zero clearance insert.

The installation of dual splitters 86 and 88 will now be described. Splitter 86 may be installed in a manner similar to that described above with respect to FIGS. 3-9. One will appreciate, however, that if there is an alignment mark 60 on the splitter that is designed for marking the location of a splitter relative to a fully raised saw blade 10, it is likely that the alignment mark 60 would not be appropriate for use with the same blade 10 being used in a partially raised position, such as with shorter saw slot 84. This is because the first exposed tooth of the saw is closer to the center of the saw blade 10 for a lowered saw blade 10 than for a fully raised blade. Therefore, there would be a greater chance that the saw blade 10 would interfere with the guide holes 62 or pegs 38 when using the alignment mark 60 with a lowered blade. This may require the splitter to be located farther away from the end of saw slot 84 with a partially lowered saw blade 10 than would otherwise be necessary with the saw blade 10 fully raised in order to avoid the possibility of the saw blade 10 damaging the splitter pegs 38. So while the overall method of installation described above may be used for splitter 86, the step of aligning the guide 36 with the tip of the first saw tooth 58 may need to be replaced by an alternative method of alignment. Such an alternative method may include marking two additional alignment lines 90, 92 on setup board 48, as illustrated in FIG. 4. In lieu of aligning the tip of the saw tooth 58 with the alignment mark 60, as illustrated in FIG. 5, the tip of the saw tooth 58 may be aligned with alignment line 92 for the installation of splitter 86. The location of alignment line 92 is selected to ensure that the saw blade does not intersect the subsequently drilled splitter location holes during use of the splitter 86, while at the same time keeping the splitter 86 as close to the saw blade 10 as practical. Thus, the method described above may be used with this one modification to install splitter 86 for making contact with the keeper piece side of the kerf.

Figure 11:
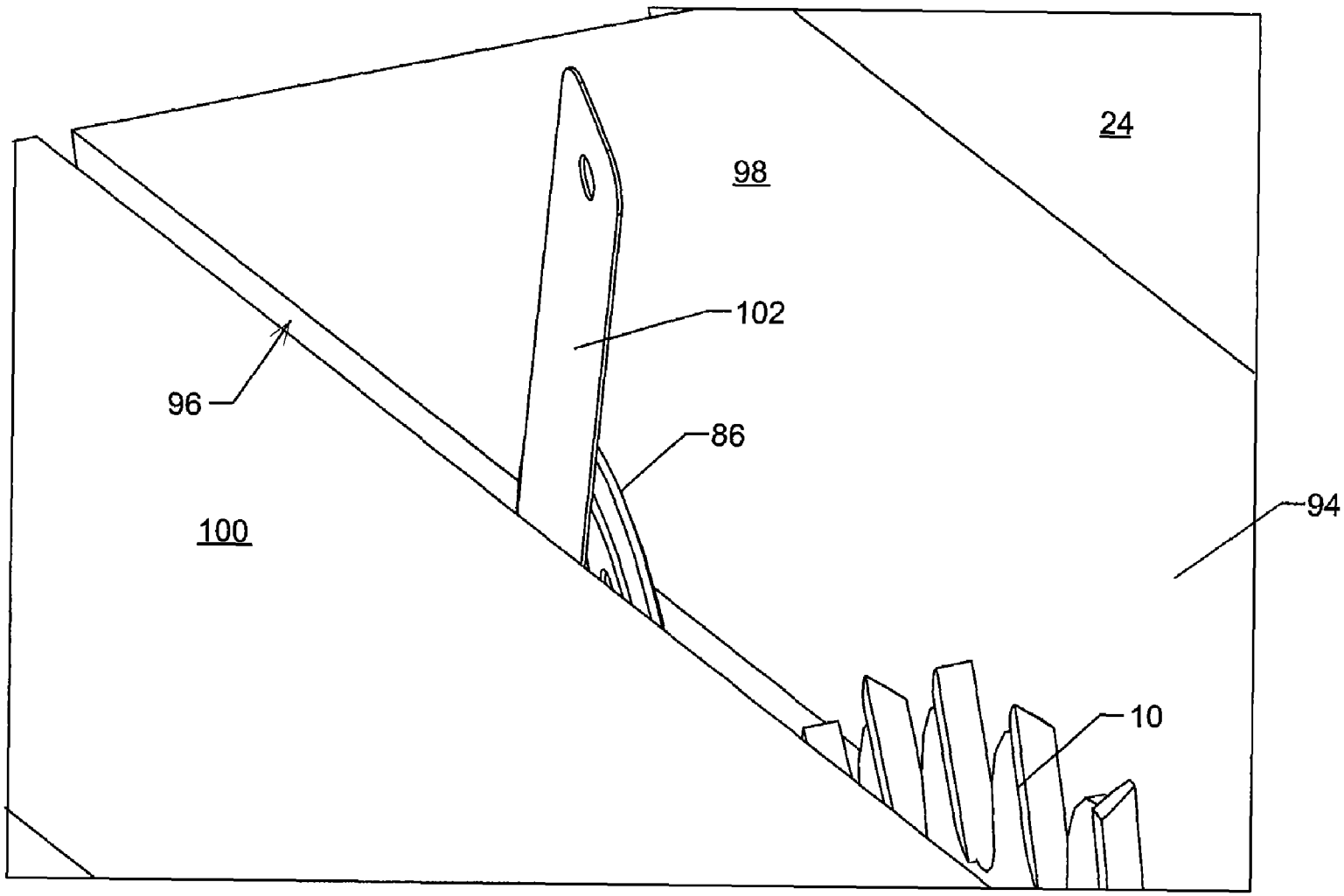
FIG. 11 illustrates the use of a feeler gauge to measure the gap between a splitter and an opposed side of the kerf.
Figure 12:
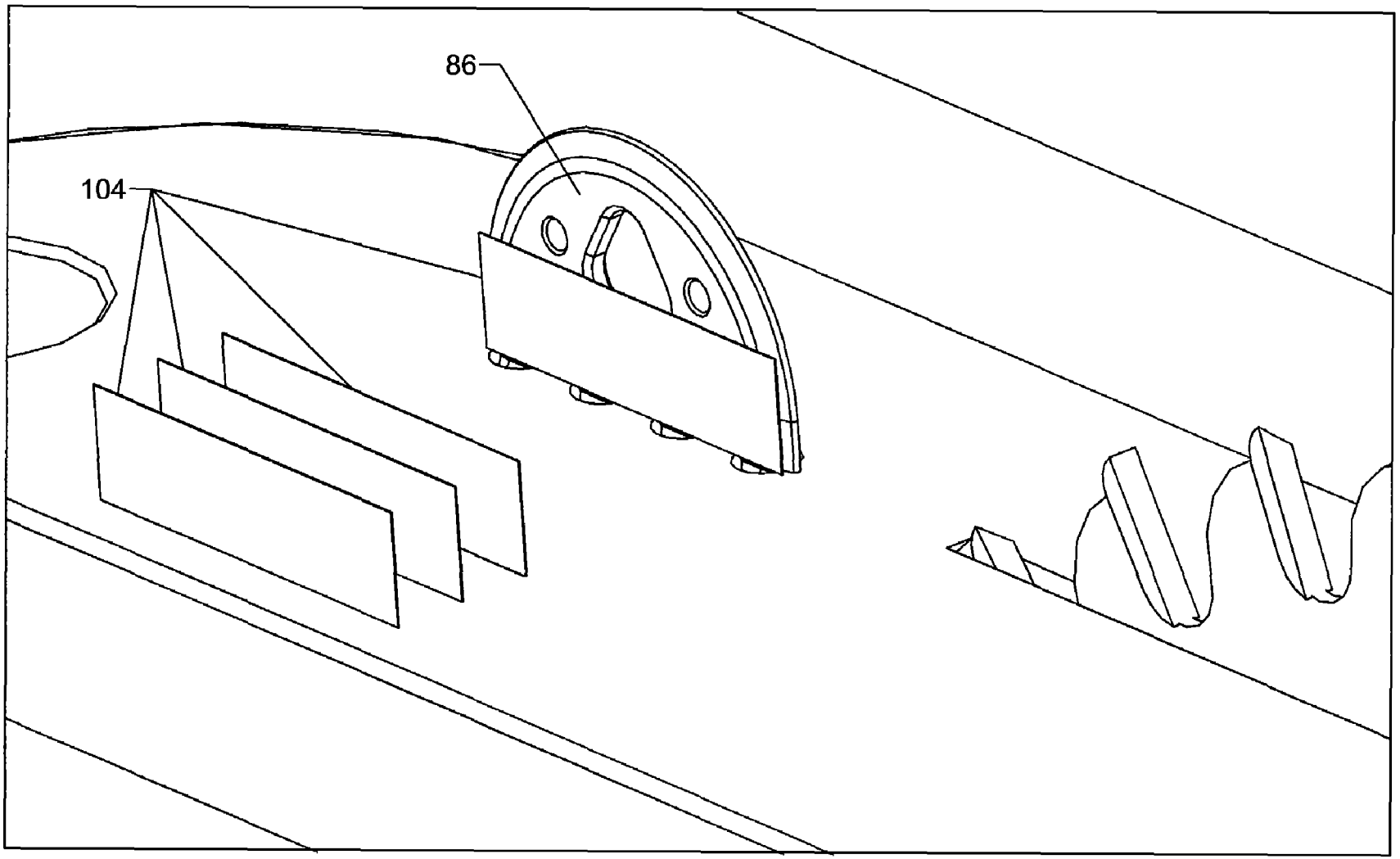
FIG. 12 illustrates the application of masking tape to a splitter to fill the gap measured in FIG. 11.
Figure 13:
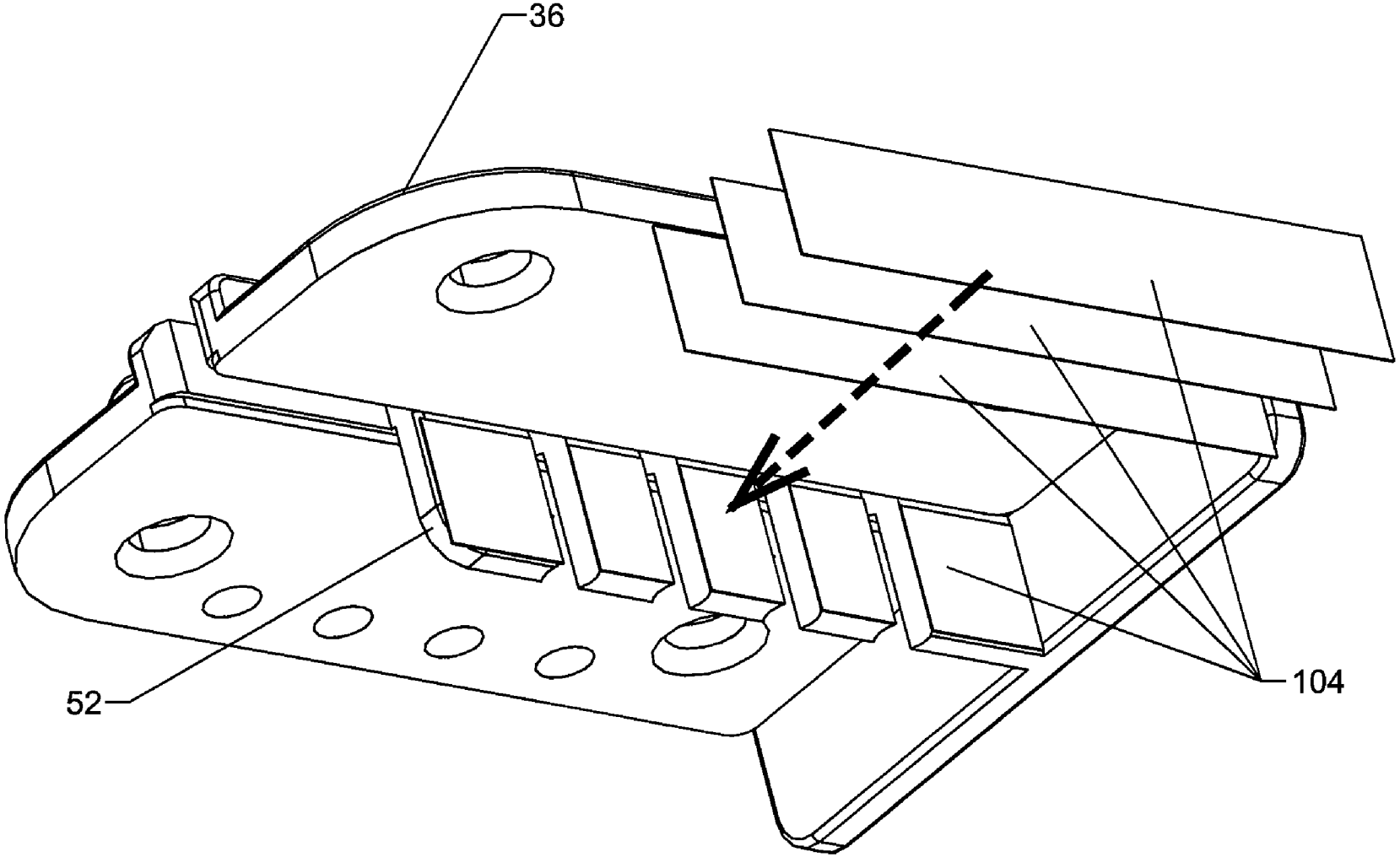
FIG. 13 is a perspective view of a drill guide showing the application of masking tape to the center rib.
Figure 14:
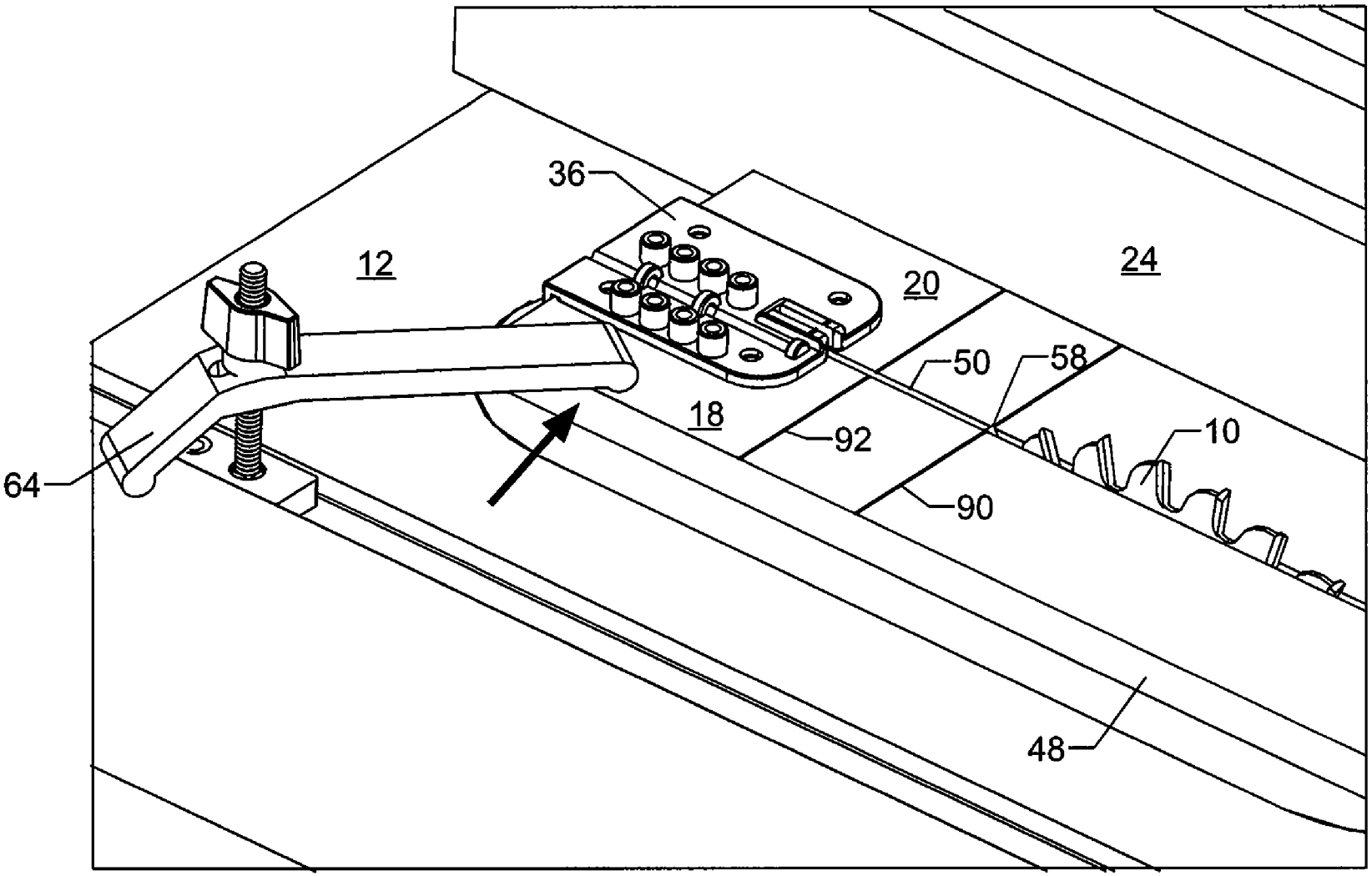
FIG. 14 is a perspective view of the installation of the taped drill guide of FIG. 13 being installed on a setup board.

A process for installing splitter 88 to make contact with the off-cut side of the kerf will now be described, beginning with FIG. 11. With splitter 86 installed, a second set-up board 94 similar to set up board 48 is cut, leaving a sufficient uncut length (not shown) to retain the kerf 96 in position. The cut may be made with a "0" side of the splitter facing the rip fence 24, and then, with the saw blade 10 stopped, splitters with different offsets may be tried until a desired degree of interference is achieved between the splitter 86 and the keeper piece 98. In this manner, there will be contact between the splitter 86 and the keeper piece 98, and there will be a small gap between the splitter 86 and the off-cut piece 100. The second splitter 88 will eliminate this gap in order to provide a safer and cleaner cut. The size of the gap is measured, such as with a feeler gauge 102. The second set up board 94 is then removed, and a material is added to the left side (gap side) of the splitter 86 in a thickness equal to the measured gap width. The inventor has found that masking tape 104, which has a thickness of about 0.004" per layer, is useful for this purpose. If a feeler gauge 102 is not available, one layer of material such as masking tape 104 at a time may be applied to the side of the splitter 86 and the set up board repositioned repeatedly until the gap is completely filled. Once the correct thickness of material (number of layers of masking tape 104) is determined, that same thickness (number of layers of masking tape 104) is applied to the right side (keeper piece side) of the center rib 52 of drill guide 36, as illustrated in FIG. 13. The first set up board 48 is then repositioned on the ZCI 42 and the work surface 12 and the drill guide installed onto the end of the board 48 with the center rib 52 inserted into the kerf 50, as illustrated in FIG. 14. The presence of the masking tape 104 causes the drill guide 36 to be moved away from the right side of the kerf 68 by the amount of the measured gap when compared to the similar installation step illustrated in FIGS. 5 and 6. The board 48 is then moved to a position where the tip of the saw blade 58 is aligned with alignment line 90, and clamp 64 is then applied while a finger pressure is exerted against the off-cut piece 18. Note that alignment line 90 is positioned a desired distance away from alignment line 92 in order to provide a desired spacing between the two splitters 86, 88. Mounting screws 66 are then installed to further secure the position of drill guide 36 and splitter location holes 106 for splitter 88 are drilled through guide holes 62 as described above. A splitter 88 with the desired amount of offset is then selected to provide a desired degree of force against the off-cut piece during use of this dual-splitter embodiment. The use of two splitters to control both sides of the kerf is especially advantageous with large sheet stock being cut on a table saw, since force applied by the left hand to keep the sheet stock against the rip fence will often cause the off-cut piece to be pushed against the rear portion of the saw blade, thus causing burn marks and/or kickback.

One skilled in the art may appreciate that the concepts described above may be implemented in devices having any variety of dimensions depending upon the particular application. The material of construction of the drill guide may be metal, plastic or other sufficiently durable material. The material of construction of the splitters should be one providing a desired degree of flexibility for exerting a force on the work piece when deformed due to the interference between the splitter and the edge of the kerf. In one embodiment, both the drill guide and the splitters are injection molded from polycarbonate material. Other methods of alignment of the location of the splitter location holes 40 may be envisioned, such as using a laser alignment device to index the holes from an edge of an actual kerf created by the saw blade 10. Other methods of creating the splitter location holes 40 may be used, such as using a laser cutting device which may be especially useful for non-circular holes.

Figures 15, 16:
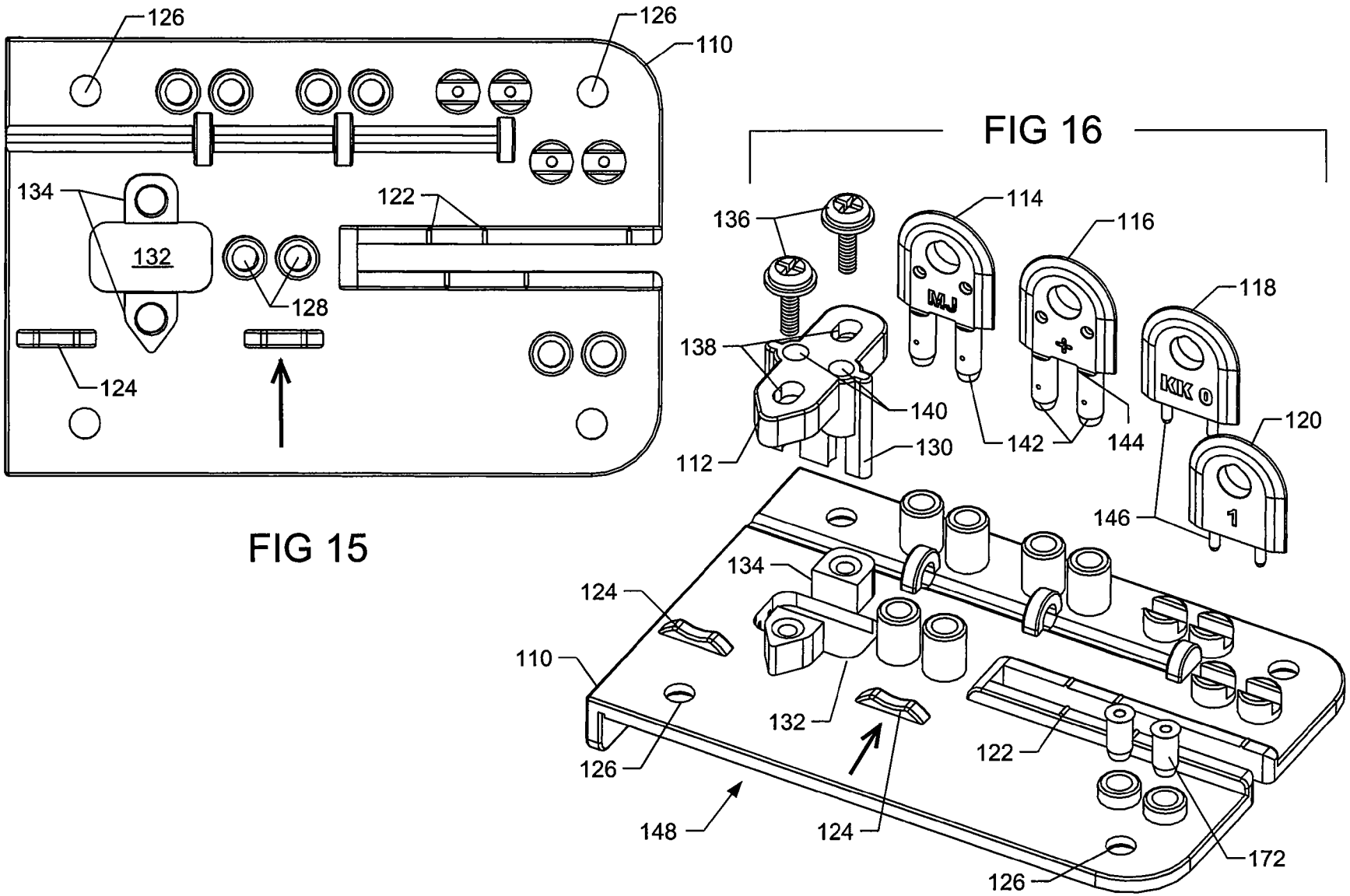
FIG. 15 is a top view of a drill guide base.
FIG. 16 is a perspective view of a kit containing the drill guide base of FIG. 15 together with its associated adjustable rear drill guide, splitters and kerf keepers.

FIGS. 15 and 16 illustrate a further embodiment of the present invention wherein a single drill guide base 110 is used to position location holes for dual splitters. FIG. 15 is a top view of the drill guide base 110, and FIG. 16 is a perspective view of the base 110 together with its associated adjustable rear drill guide 112 and an assortment of kerf control apparatus such as splitters 114, 116 and kerf keepers 118, 120 as will be described in more detail below. Drill guide base 110 is installed on a setup board in the manner described above with respect to FIG. 4, with the tip of the blade being aligned with an appropriate one of the alignment marks corresponding to the planned height of the saw blade for use with the installed splitters. The saw blade is then lowered without altering the position of the setup board and the setup board is secured into position, such as with screws 66 and a clamp 64 as shown in FIG. 6. The screws 66 should be fastened to the keeper piece 20 while applying finger pressure toward the fence (in the direction of the arrow of FIG. 16) in order to keep the center rib (not shown) of the drill guide 110 in full contact with the right edge 68 of the kerf 50 (actual cut edge of the keeper piece). Then, the screws 66 are secured to the off-cut piece 18 without applying any finger pressure and with the kerf 50 in its normal-width state. Lastly, the clamp should be fastened against the setup board with the drill guide 110 securely fastened on it. Due to the construction of the drill guide base 110, this action will align the centers of guide holes 128 at a predetermined fixed distance from, and in a line parallel to, the right edge of the kerf. First splitter location holes for a first splitter (in a line behind the saw blade 154) are then drilled into the underlying zero clearance insert by inserting a drill bit with a predetermined diameter through each of the guide holes 128, thereby providing a known alignment referenced from the actual cut edge of the keeper piece.

The drill guide base 110 may then be used to locate location holes for a second of dual splitters. To locate such second location holes, the adjustable rear drill guide 112 is installed onto the base 110 by inserting its downwardly extending rib members 130 through the opening 132 in the base 110 and into the underlying kerf. The underside (not shown) of the rear drill guide 112 includes a slot to receive the upwardly projecting pedestal 134 to provide a fixed position relative to the axis of the kerf, but to allow a sliding, adjustable position perpendicular to the axis of the kerf. In this manner, ribs 130 may be moved from side to side within the kerf to make selective contact with either the right side (keeper piece side) or left side (waste piece side). When using the drill guide base 110 and adjustable rear drill guide 112 to create location holes for dual splitters 114, 116, the rear drill guide 112 would be moved to make contact with the left side, i.e. the opposite of the side in contact with the center rib of the drill guide base 110. The rear drill guide is then affixed to the drill guide base 110 in this position with screws 136 which are inserted through slotted holes 138, and the second set of location holes is formed in the zero clearance insert by inserting a drill bit with a predetermined diameter through guide holes 140. The drill bit diameter may preferably be the same as the diameter of the guide holes 140 and the peg 142 in order to augment the precision of the fit of the pegs into the resulting location holes 160. The clamp is then released and the entire setup is removed and the zero clearance insert is ready to receive dual splitters such as 114, 116. As described above, the offset of the splitters may be selected to provide a desired degree of interference between the splitter and the respective sides of the kerf.

It is known that some solid wood boards contain internal stresses resulting from the growth pattern of the tree from which the board is formed or from a high level of moisture causing the board to become unstable. When such boards are cut with a saw, there may be a tendency for the kerf to close behind the saw blade due to these internal forces. This is particularly true for a rip cut (in a direction generally parallel to the grain of the wood). In some cases, these forces may be sufficient to cause a significant amount of drag by the kerf against the splitter and the saw blade, resulting in an increase in force necessary to push the work piece through the saw blade. Unfortunately, there is no sure way to predict if a board will react in this manner before the cut is made.

FIGS. 16-20 illustrate an embodiment of the present invention that addresses the special requirements of rip cutting boards that may contain internal stresses that cause the kerf to close about a splitter. Note that the splitters 114, 116 of FIG. 16 are illustrated as including only two location pegs 142 and thus are shorter along an axial length parallel to the axis of the kerf than are the splitters 32, 34 of FIG. 2, which have four pegs each. This allows the overall length of the splitter 114, 116 to be kept short, such as about 0.75 inches in one embodiment, so that the closing kerf can easily pass around the splitter without prolonging the frictional contact between the splitter and the work piece. Any number of pegs may be used, and the pegs may have any cross-sectional shape; thus, the embodiments illustrated are not meant to be limiting. Furthermore, the pegs 142 of splitters 114, 116 are purposefully made to be strong enough to resist bending when acted upon by the forces of a pinching kerf. In one embodiment, illustrated in the partial cut-away view of FIG. 20, the a splitter 114 may be formed to have a metal core 174 surrounded by injection-molded plastic 176, with the metal core 174 extending into each peg 142 in the form of a metal pin 178 that resists bending. In one embodiment the metal core 174 is formed of stainless steel plate material having a thickness of about 0.040" that is stamped or die cut to the desired shape which includes the integrally formed metal pins 178. The thickness of the metal core is selected to provide a desired degree of stiffness to the splitter, and the thickness of the overlying plastic material 176 is selected to provide a desired overall thickness (width) to the splitter 114. The embodiment utilizing a 0.040" thick metal core 174 may be coated with plastic to have an overall thickness of 0.087" for a thin kerf or an overall thickness of 0.118" for a full kerf, for example. The use of an injection molded plastic coating covering a metal core provides a unique combination of features and benefits. The metal core may be formed of relatively inexpensive stamped or die cut sheet stock. While the overall dimensions of the splitter must be held to a tight tolerance, the stamped or die cut material may be used without the need for any secondary treatment such as sanding or machining because the precision of the outer dimensions of the splitter is provided by mold used to form the injection molded plastic outer coating.

The pegs of splitters 114, 116 may be formed to have a relatively large diameter or width dimension, such as a diameter that exceeds the width of the kerf or the width of the generally planar upper portion of the splitter, with a small land 144 being formed between the top of the peg 142 and the bottom of the body of the splitter and defined by a transition from the width of the pegs to the width of the generally planar portion. For a splitter formed with a die cut or stamped metal core, the land 144 may be formed into the shape of the overlying plastic coating 176. The length of the pegs 142 may also be extended to a relatively greater depth into the location holes formed in the zero clearance insert. Thus, splitters 114, 116 are likely to remain in position even when used to cut boards with a large degree of internal stress, due to one or more of the following features: a short spacing between pegs which resists rotation of the splitter, the strength of the pegs which resists bending of the pegs, the width of the pegs which will cause the land 144 to come into contact with the bottom of the work piece should the splitter begin to lift out of position, and the length of the pegs which prevents them from leaving the location holes even if the splitter lifts to a small degree. The weight of the work piece and the downward pressure applied by the operator onto the work piece function to oppose vertical movement of the land 144 and thus prevent the splitter being lifted. One such splitter 114, 116 (selected to have a desired degree of offset) may be used in the first location directly behind the saw blade in combination with one kerf keeper 118, 120 installed in the second location behind the first splitter. The kerf keeper 118, 120 is designed so that it will be removed from its installed location behind the splitter by the pinching action of a kerf that is subject to internal stress and that closes against the kerf keeper. In the embodiment of the kerf control apparatus 148 illustrated in FIG. 16, the kerf keepers 118, 120 are formed to have relatively small, short, weak pegs 146 that are easily bent or broken away when the kerf keeper is pulled upon by the pinching kerf. Other embodiments may include a notch or break-away point designed into the peg so that the upper body of the kerf keeper can be pulled away from the lower portion of the pegs with a desired low amount of force. Alternatively, and as illustrated in FIGS. 16-18, the width of the pegs is less than the width of the generally planar portion of the kerf keeper and less than the width of the kerf so that the pegs may be pulled along with the generally planar portion into the kerf to travel with the work piece when the kerf closes around the kerf keeper.

The drill guide base 110 and adjustable rear drill guide 112 may be used to locate the location holes used for the dual splitter/kerf keeper combination. The procedure is much alike the procedure described above for locating the location holes for dual splitters; however, with several important differences. First, it is desired that the kerf keeper be located within the kerf at a position where it will not contact the kerf as long as the kerf remains straight and there is no pinching action caused by residual stresses within the work piece. It is also desired to position the kerf keeper directly behind and close to the splitter so that the leading edge of a work piece having a closing kerf will not catch the front edge of the kerf keeper, thereby possibly dislodging the kerf keeper before it can enter the kerf. In this regard, the adjustable rear drill guide 112 is installed so that its downwardly projecting ribs 130 are positioned against the right edge of the kerf (the same side as is touched by the center rib of the guide base 110), thus positioning the location holes for the kerf keeper directly behind the location holes for the splitter. The kerf keeper 118, 120 may then be selected to have the same offset as the splitter 114, 116, or preferably, to have an offset that positions the vertical upper body portion of the kerf keeper slightly away from making contact with the right edge of the kerf; for example, 0.003 inches farther away from the fence in one embodiment. In this manner, a straight kerf will not exert removal force against the kerf keeper; however, a kerf subject to internal stresses that even lightly pinches the kerf keeper will tend to extract the kerf keeper from its installed location behind the splitter and carry it with the work piece. In some embodiments the kerf keeper may be thinner than the splitter, such as having an overall thickness that is 0.004"-0.005" thinner (or approximately 0.002" thinner per side). In this manner, the splitter/kerf keeper combination provides both a splitter function and a kerf keeper function even in the event of an internally stressed board and a closing kerf. When the operator sees the kerf keeper beginning to move, he/she will know that the kerf is beginning to pinch. Note that once the kerf keeper is pulled out of its installed position behind the splitter by a closing kerf, the operator should be instructed to stop the saw for safety reasons and to take additional safety precautions as appropriate.

Figure 17:
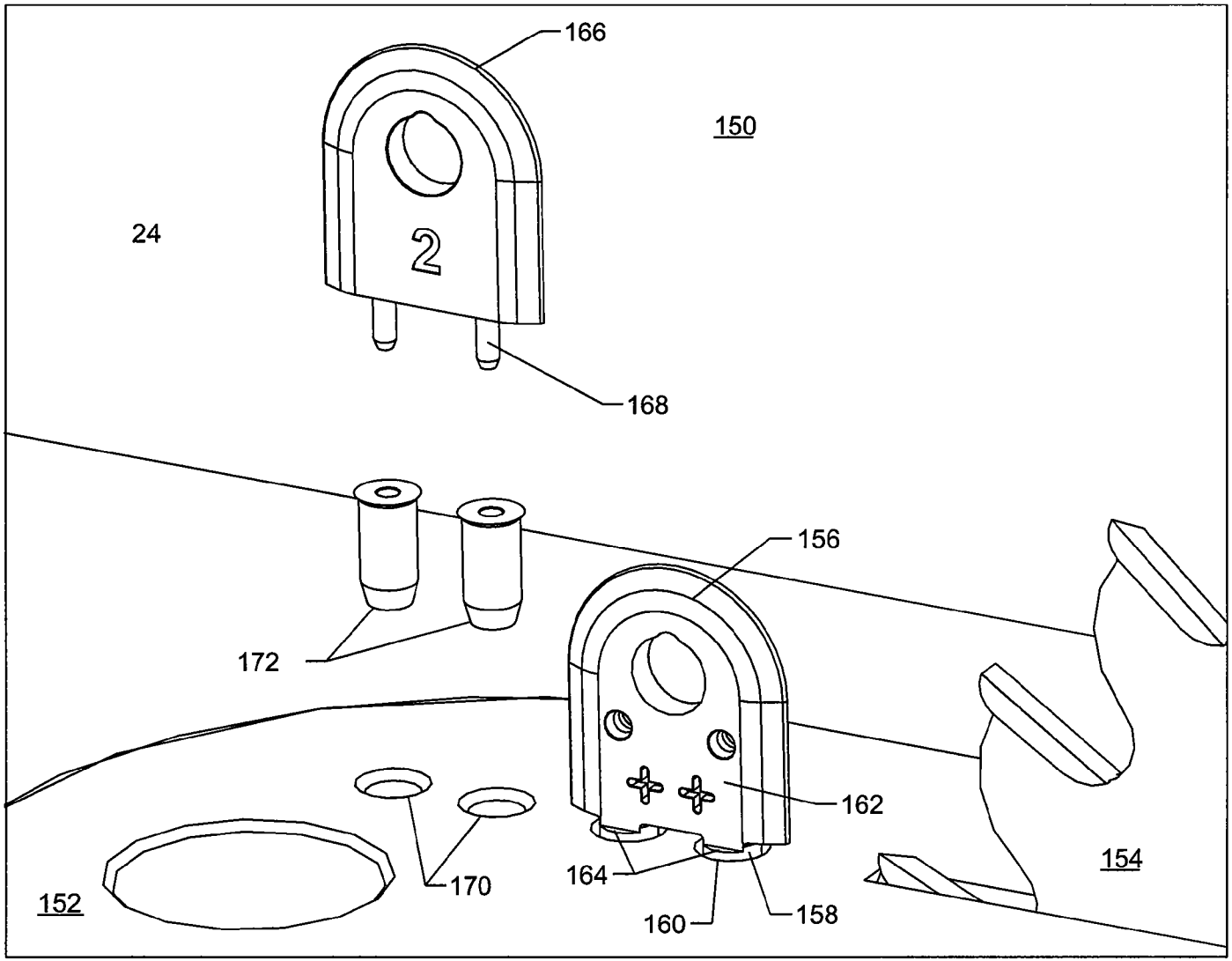
FIG. 17 is a perspective view of a splitter/kerf keeper combination being installed.
Figure 18:
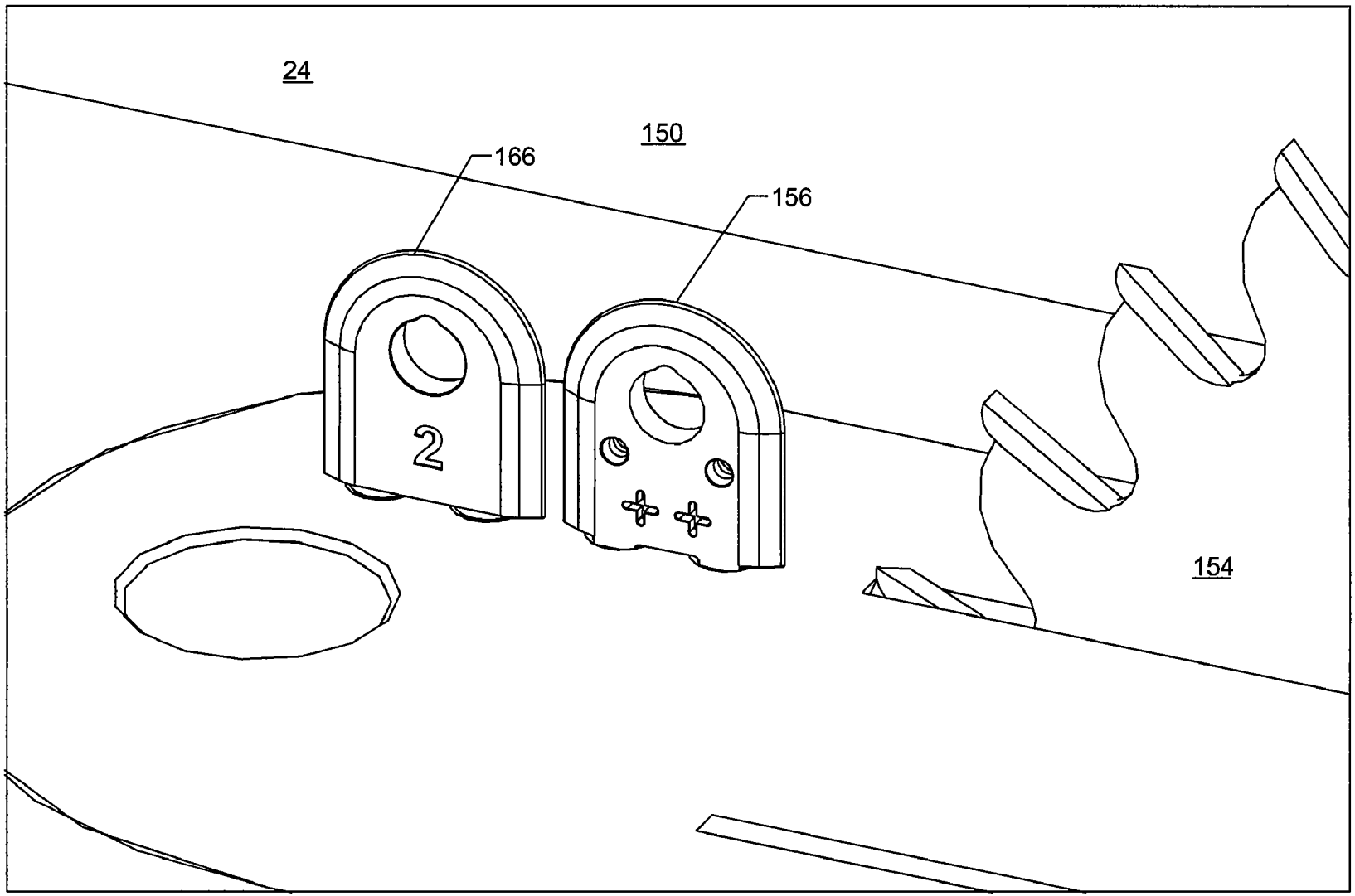
FIG. 18 is the splitter/kerf keeper combination of FIG. 17 fully installed.
Figure 19:
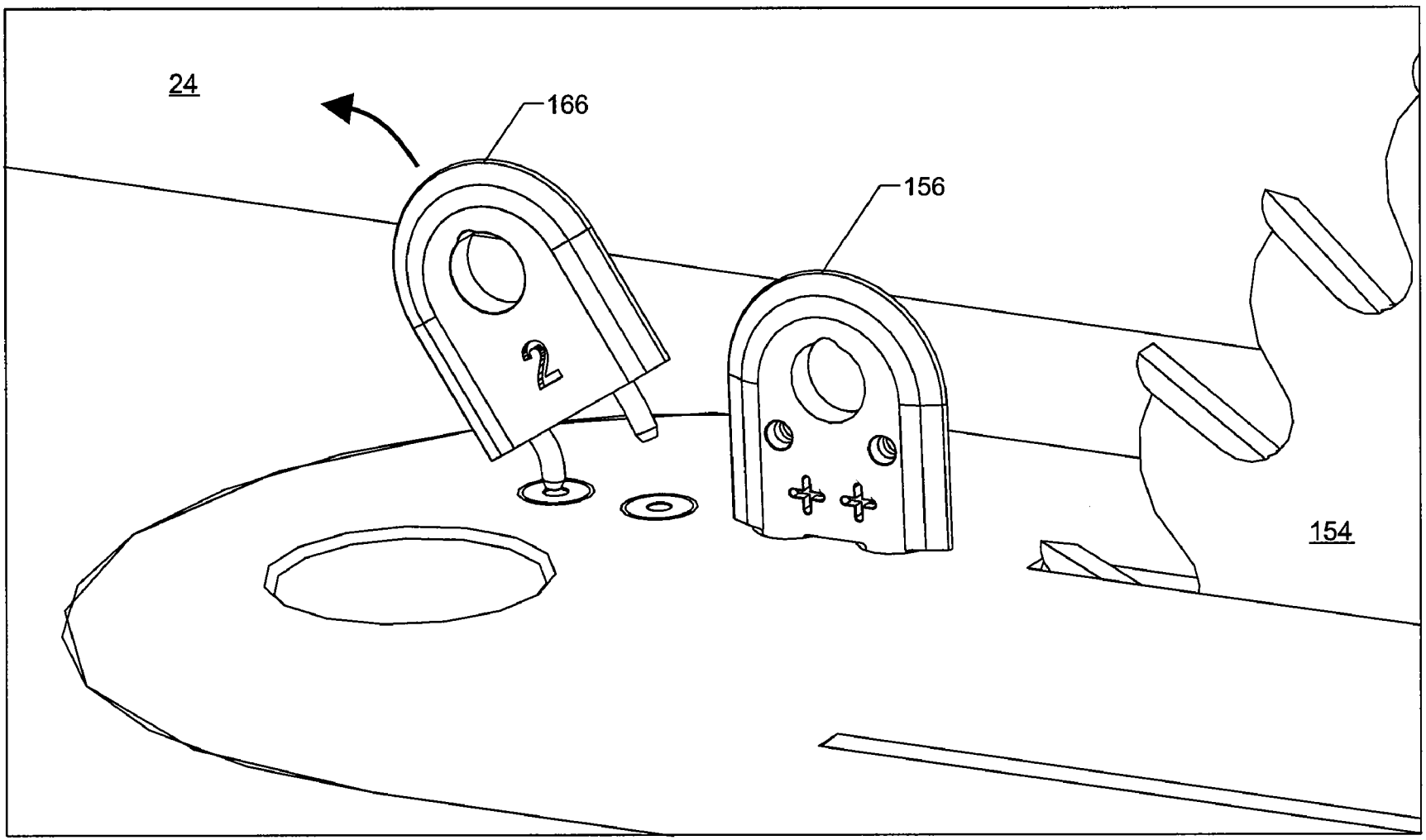
FIG. 19 is the splitter/kerf keeper combination of FIG. 17 showing the kerf keeper in a partially dislodged position as may occur due to a pinching kerf.
Figure 20:
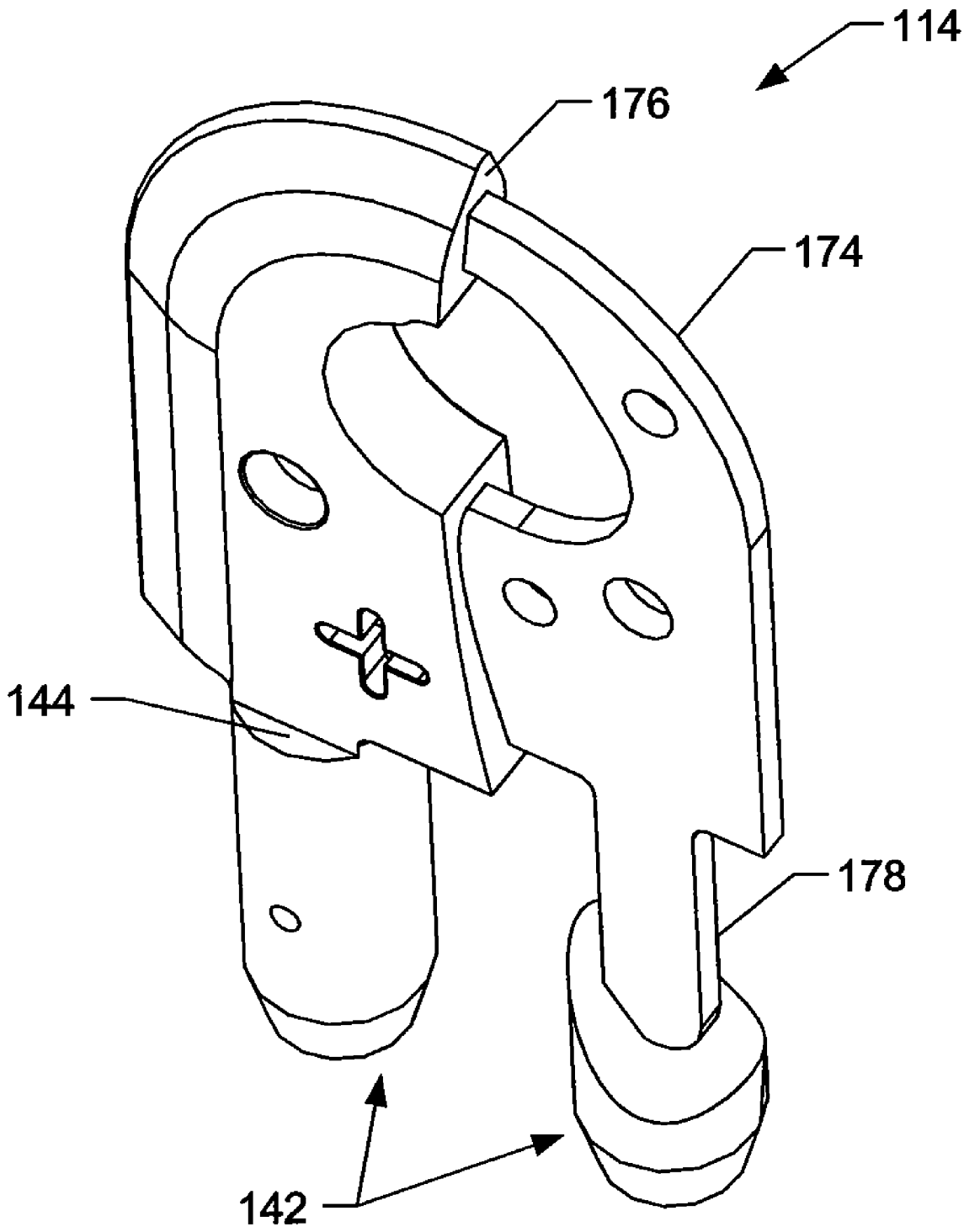
FIG. 20 is a partially cut away perspective view of a splitter illustrating its construction.

FIG. 17 illustrates an embodiment of a splitter/kerf keeper combination 150 being installed into a zero clearance insert 152 behind a saw blade 154. The splitter 156 has two pegs 158 inserted into respective location holes 160 that were located by using a device such as drill guide base 110 of FIGS. 15 and 16. The pegs 158 are larger than the upwardly extending body 162 of the splitter; thereby defining respective lands 164 at the top of the pegs 158. The pegs 158 have a width that is larger than the width of the kerf to prevent the splitter 156 from being pulled upward through the kerf and are strong enough to resist bending if pinched by the kerf. The kerf keeper 166 has two smaller, weaker, easily bendable pegs 168 that are smaller in width than the kerf and no greater than a width of the generally planar portion of the kerf keeper so that they may pass into the kerf. Since the guide holes 140 of the adjustable rear drill guide 112 that was used to position the location holes 170 may be of a larger size to facilitate the use of the drill guide base 110 for dual splitter applications, it may be necessary to use sleeves 172 in the location holes 170 to receive the pegs 168 with a precise position. FIG. 18 illustrates the splitter/kerf keeper combination 150 in its installed position ready for use. FIG. 19 illustrates a condition of the combination 150 when it is acted upon by a work piece having residual stresses that cause a pinching action of the kerf. The splitter 156 remains in position to control the location of the right side of the kerf relative to the saw blade 154 and the fence 24. The kerf keeper 166 is easily removed from its installed position of FIG. 18 and automatically begins to travel with the kerf when pinched (in the direction of the arrow) to maintain the kerf separation, thereby significantly reducing the binding forces on the splitter 156 and saw blade 154 and preventing such binding forces from causing excessive friction between the work piece and the spinning saw blade, which could otherwise cause burning and smoking of the work piece, stalling of the saw blade motor, and even the possibility of body injury to the operator.

Thus, the combination of a firmly mounted splitter 156 and an easily-removable kerf keeper 166 provides an improved degree of safety when cutting a work piece that contains residual stresses that may cause pinching of the kerf. The kerf keeper of the present invention functions as an automatic kerf keeper in the sense that, once it is in position, it responds automatically to a closing kerf to keep the kerf open. The kerf keeper of the present invention also functions as a passive safety device in the sense that, once it is in place, no additional action is required on the part of the operator in order to ensure that the kerf remains open in spite of the unpredictable occurrence of a closing kerf resulting from internal stress in the board that may be undetected by the operator. The kerf keeper may be reusable, such as when the pegs simply bend when the kerf keeper is launched from its originally installed position, or it may be sacrificial, such as when the pegs are designed to break off at launch. The combination of a splitter and a following kerf keeper may be selected when ripping natural wood; while a combination of two splitters, with one contacting each side of the kerf, may be selected when cutting a dimensionally stable work piece such as plywood or other man-made material.

While various embodiments of the present invention have been shown and described herein, it will be obvious that such embodiments are provided by way of example only. Numerous variations, changes and substitutions may be made without departing from the invention herein. For example, it should be appreciated that the kerf keeper 166 may be installed into its original position, as shown in FIG. 18, by any number of other installation schemes. For instance, in one embodiment, a kerf keeper may be supported from/with the splitter 156 or from/with a European style riving knife, such as by a clip, retractable ball bearing, magnetic attachment, etc. In another embodiment, a kerf keeper may be held in its original position by a magnetic attachment to the zero clearance insert/saw table, or to metal/magnet insert in the zero clearance insert/saw table, or from a groove in the zero clearance insert/saw table, or in any other manner from below or above the work surface of the table saw. Importantly, the kerf keeper is held in its original position only until it is pinched by the kerf whereupon it becomes dislodged and travels with the kerf; whereas, the splitter 156 is capable of resisting the pinching/pulling action of a pinched kerf to remain in position to function as a splitter. The embodiments illustrated in FIGS. 15-20 are provided by way of example and are not meant to be limiting.

The invention claimed is:

1. A kerf control apparatus comprisising:

a splitter configured to be disposed within a kerf created in a work piece along a line behind a blade of a table saw and to remain at a fixed location along the line behind the blade even if the kerf closes behind the splitter; and a kerf keeper separate from the splitter and configured to be disposed within the kerf behind the splitter while the kerf remains open and to be captured by the closing kert and to move along the line away from the saw blade and away from the splitter with the work piece when the kerf closes behind the splitter, wherein the splitter further comprises:

a generally planar portion for extending into the kerf; and a plurality of pegs extending from the generally planar portion for extending into respective holes formed into a surface of the table saw, the pegs each comprising a width dimension greater than a width dimension of the generally planar portion, a difference in the width dimensions defining a land for contacting a bottom of the work piece to retain the pegs In their respective holes and thus to retain the splitter in the fixed location.

2. The apparatus of claim 1, wherein the generally planar portion comprises a first side disposed in a first plane located a first distance from a centerline defined by the plurality of pegs and a second side opposed the first side and disposed in a second plane located a second distance from the centerline, the first and second distances being not equal.

3. A kerf control apparatus comprising:

a splitter configured to be disposed within a kerf created in a work piece along a line behind a blade of a table saw and to remain at a fixed location along the line behind the blade even if the kerf closes behind the splitter; and a kerf keeper separate from the splitter and configured to be disposed within the kerf behind the splitter while the kerf remains open and to be captured by the closing kerf and to move along the line away from the saw blade and away from the splitter with the work piece when the kerf closes behind the splitter, wherein the kerf keeper further comprises:

a generally planar portion for extending into the kerf; and a plurality of pegs extending from the generally planar portion for extending into respective holes formed into a surface of the table saw, the pegs each comprising a width dimension no greater than a width dimension of the generally planar portion so that they are enabled to pass into the kerf with the generally planar portion as the kerf keeper is captured by the closing kerf.

* * * * *